US009768537B2

(12) United States Patent
Kim et al.

(10) Patent No.: US 9,768,537 B2
(45) Date of Patent: Sep. 19, 2017

(54) CONNECTING TERMINAL DEVICE AND ELECTRONIC DEVICE INCLUDING THE SAME

(71) Applicants: Samsung Electronics Co., Ltd., Gyeonggi-do (KR); HYUPJINCONNECTOR Co., Ltd., Gyeonggi-do (KR)

(72) Inventors: Kyung-Jong Kim, Gyeongsangbuk-do (KR); Seung-Kyo Hong, Gyeonggi-do (KR); Yang-Jean Park, Gyeonggi-do (KR); Jin-Woo Park, Gyeonggi-do (KR)

(73) Assignees: Samsung Electronics Co., Ltd., Yeongtong-gu, Suwon-si, Gyeonggi-do (KR); Hyupjinconnector Co., Ltd., Danwon-gu, Ansan-si, Gyeonggi-do (KR)

( * ) Notice: Subject to any disclaimer, the term of this patent is extended or adjusted under 35 U.S.C. 154(b) by 0 days.

(21) Appl. No.: 15/084,901

(22) Filed: Mar. 30, 2016

(65) Prior Publication Data

US 2016/0294095 A1 Oct. 6, 2016

(30) Foreign Application Priority Data

Mar. 31, 2015 (KR) ..... 10-2015-0045717
Nov. 11, 2015 (KR) ..... 10-2015-0158273

(51) Int. Cl.
*H01R 12/00* (2006.01)
*H01R 12/71* (2011.01)
(Continued)

(52) U.S. Cl.
CPC ..... *H01R 12/714* (2013.01); *H01R 12/7076* (2013.01); *H01R 12/718* (2013.01); *H01R 13/2464* (2013.01)

(58) Field of Classification Search
CPC ..... H01R 12/714; H01R 12/7076; H01R 12/718; H01R 13/2464
(Continued)

(56) References Cited

U.S. PATENT DOCUMENTS 5,600,092 A * 2/1997 Patscheck ..... H01R 4/64 174/351
6,149,443 A * 11/2000 Moran ..... H01R 13/2435 439/66
(Continued)

FOREIGN PATENT DOCUMENTS

KR 10-1470746 B1 12/2014

*Primary Examiner* — Abdullah Riyami
*Assistant Examiner* — Nelson R Burgos-Guntin
(74) *Attorney, Agent, or Firm* — Cha & Reiter, LLC.

(57) ABSTRACT

A connecting terminal device may include: a bottom plate; a movable part provided on a rear surface of the bottom plate that is configured to be electrically connected to an external object as the movable part is pressed or raised; one or more protective walls provided on side surfaces of the bottom plate; pressing preventing parts provided at ends of the protective walls and provided between the bottom plate and the movable plate to restrict a pressing movement of the movable part; and rising preventing parts provided on side surfaces of the protective walls to restrict a rising movement of the movable part.

43 Claims, 17 Drawing Sheets

(51) Int. Cl.
*H01R 12/70* (2011.01)
*H01R 13/24* (2006.01)

(58) Field of Classification Search
USPC ..... 439/81, 862, 92
See application file for complete search history.

(56) References Cited

U.S. PATENT DOCUMENTS 6,493,241 B1 * 12/2002 Horng ..... H05K 9/0064 206/719
8,052,428 B2 * 11/2011 Tsao ..... H01R 4/4809 439/66
8,298,021 B2 * 10/2012 Huang ..... H01R 13/2442 439/500
2002/0086591 A1 * 7/2002 Orihara ..... H01R 13/2442 439/862
2011/0063186 A1 * 3/2011 Park ..... H01Q 1/12 343/892
2011/0177718 A1 * 7/2011 Shen ..... H01R 12/714 439/625
2016/0294095 A1 * 10/2016 Kim ..... H01R 12/714

* cited by examiner

CONNECTING TERMINAL DEVICE AND ELECTRONIC DEVICE INCLUDING THE SAME

CLAIM OF PRIORITY

This application claims priority under 35 U.S.C. §119(a) to Korean Application Serial Nos. 10-2015-0045717 & 10-2015-0158273, which were filed in the Korean Intellectual Property Office on Mar. 31, 2015 and Nov. 11, 2015, the entire contents of which are hereby incorporated by reference.

TECHNICAL FIELD

The present disclosure generally relates to a connecting terminal device mounted on an electronic device.

BACKGROUND

In general, a connecting terminal device is applied to various electronic devices, such as a mobile phone, an MP3 player, a portable multimedia player (PMP), a tablet PC, a Galaxy Tab™, an I-Pad™, and an electronic book terminal in order to electrically connect the electronic devices to an external lead wire.

The connecting terminal device is configured such that a bottom plate that is fixed to a substrate and a movable part that is movable upwards and downwards to be connected to an object form a C-clip form. Here, the movable part includes a connecting part that directly forms a contact point with the object, a resilient part that endows the connecting part with resiliency when a connection is applied to the connecting part, and an absorption surface that connects the connecting part and the resilient part.

The connecting terminal device functions to properly disperse a deformation load through the resilient deformation of the resilient part if an external object is connected to the connecting part, and to electrically connect electronic components while maintaining a balance of the connecting part for smooth connection.

SUMMARY

However, because the C-clip type connecting terminal device, according to the related art, is configured such that one end of the connecting part has a free end form that is not constrained while forming a predetermined interval with the bottom plate, the entire movable part containing the connecting part may be excessively pressed downwards, be excessively raised upwards, or be excessively twisted laterally by an external force applied from the upper side to the lower side of the connecting part, an external force applied from the lower side to the upper side of the connecting part, or an external force applied from the front side or a lateral side from the connecting part, so that a connection inferiority according to the deformation of the connecting terminal device may be frequently caused.

Moreover, in the connecting terminal device according to the related art, a resilient force of the resilient part is gradually lowered by a repeated pressing operation so that a stable connection is not achieved because the restoring force of the connecting part is lowered, a plastic deformation of the resilient part is caused when an excessive external force that exceeds the resilient limit of the resilient part is applied, and accordingly, a connection to an external object cannot be achieved because the connecting part cannot return to the initial position.

As a result, a device that is capable of preventing a deformation of the connecting terminal device by restricting an abnormal movement of the movable part from external forces of various directions applied to the connecting terminal device, and preventing the resilient force of the resilient part from being lowered or lost according to a consistent and repeated pressing operation of the connecting terminal device is required.

Accordingly, various embodiments of the present disclosure provide a connecting terminal device that includes prevention parts for limiting pressing movement and rising movement of a movable part in protective walls to prevent the deformation of a product by restricting an abnormal movement of a movable part from external forces of various directions, and to prevent the lowering and loss of the resilient force of the product as the movable part is repeatedly pressed and raised.

In accordance with an aspect of the present disclosure, there is provided a connecting terminal device including: a bottom plate; a movable part provided on a rear surface of the bottom plate to be electrically connected to an external object as the movable part is pressed or raised; one or more protective walls provided on side surfaces of the bottom plate; pressing preventing parts provided at ends of the protective walls and provided between the bottom plate and the movable plate to restrict a pressing movement of the movable part; and rising preventing parts provided on side surfaces of the protective walls to restrict a rising movement of the movable part.

In accordance with another aspect of the present disclosure, there is provided a connecting terminal device including: a bottom plate; a movable part connected to a rear surface of the bottom plate in a curved fashion and pressed or raised by a resilient force to be electrically connected to an external object; one or more protective walls provided on side surfaces of the bottom plate to protect the movable part; pressing preventing parts provided at ends of the protective walls and provided between the bottom plate and the movable plate to make contact with the movable plate as the movable plate is pressed, thereby restricting a pressing movement of the movable part; rising preventing parts provided on side surfaces of the protective walls to prevent a rising movement of the movable part so as to prevent the movable part from being separated from the protective walls; and a stopper provided on the bottom plate to restrict the movement of the movable part in a pressing direction.

In accordance with another aspect of the present disclosure, there is provided a connecting terminal device including: a bottom plate; one or more protective walls provided on side surfaces of the bottom plate to protect the movable part; pressing preventing parts provided at ends of the protective walls and provided between the bottom plate and the movable part to make contact with the movable part as the movable part is pressed so as to be connected to the rear surface of the bottom plate in a curved fashion, so that the pressing preventing parts are pressed or raised by a resilient force such that the pressing movement of the movable part electrically connected to the external object is restricted; and rising preventing parts provided on side surfaces of the protective walls to prevent a rising movement of the movable part so as to prevent the movable part from being separated from the protective walls.

In accordance with another aspect of the present disclosure, there is provided a connecting terminal device including: a bottom plate; a movable part connected to a rear surface of the bottom plate in a curved fashion and pressed or raised by a resilient force to be electrically connected to an external object; one or more protective walls provided on side surfaces of the bottom plate to protect the movable part; first pressing preventing parts provided at ends of the protective walls and provided between the bottom plate and the movable plate to make contact with the movable plate as the movable plate is pressed, restricting a pressing movement of the movable part; a second pressing preventing part provided at one end of the movable part such that one end of the movable part makes contact with the bottom plate as the movable part is pressed, thereby restricting a rising movement of the movable part; and rising preventing parts provided on side surfaces of the protective walls to prevent a rising movement of the movable part so as to prevent the movable part from being separated from the protective walls.

In accordance with another aspect of the present disclosure, there is provided a connecting terminal device provided in an electronic device, the connecting terminal device including: a substrate provided in the electronic device; a bottom plate fixed to the substrate; a movable part connected to a rear surface of the bottom plate in a curved fashion and pressed or raised by a resilient force to be electrically connected to an external object; one or more protective walls provided on side surfaces of the bottom plate to protect the movable part; pressing preventing parts provided at ends of the protective walls and provided between the bottom plate and the movable plate to make contact with the movable plate as the movable plate is pressed, thereby restricting a pressing movement of the movable part; rising preventing parts provided on side surfaces of the protective walls to prevent rising movement of the movable part so as to prevent the movable part from being separated from the protective walls; and a stopper provided on the bottom plate to restrict movement of the movable part in a pressing direction.

In accordance with another aspect of the present disclosure, there is provided a connecting terminal device provided in an electronic device, the connecting terminal device including: a substrate provided in the electronic device; a bottom plate fixed to the substrate; a movable part connected to a rear surface of the bottom plate in a curved fashion and pressed or raised by a resilient force to be electrically connected to an external object; one or more protective walls provided on side surfaces of the bottom plate to protect the movable part; pressing preventing parts provided at ends of the protective walls and provided between the bottom plate and the movable plate to make contact with the movable plate as the movable plate is pressed, restricting a pressing movement of the movable part; and rising preventing parts provided on side surfaces of the protective walls to prevent a rising movement of the movable part so as to prevent the movable part from being separated from the protective walls.

In accordance with another aspect of the present disclosure, there is provided a connecting terminal device provided in an electronic device, the connecting terminal device including: a substrate provided in the electronic device; a bottom plate fixed to the substrate; a movable part connected to a rear surface of the bottom plate in a curved fashion and pressed or raised by a resilient force to be electrically connected to an external object; one or more protective walls provided on side surfaces of the bottom plate to protect the movable part; first pressing preventing parts provided at ends of the protective walls and provided between the bottom plate and the movable plate to make contact with the movable plate as the movable plate is pressed, restricting a pressing movement of the movable part; a second pressing preventing part provided at one end of the movable part such that one end of the movable part makes contact with the bottom plate as the movable part is pressed, thereby restricting a rising movement of the movable part; and rising preventing parts provided on side surfaces of the protective walls to prevent a rising movement of the movable part so as to prevent the movable part from being separated from the protective walls.

In accordance with another aspect of the present disclosure, there is provided a connecting terminal device including: a bottom plate; a fixed plate provided on the bottom plate; side plates provided on the bottom plate and opposite side surface of the fixed plate; a front plate provided on the front surface of the bottom plate, the fixed plate, and the side plates to be coupled thereto; a movable part connected to the rear surface of the fixed plate in a curved fashion and protruding to the outside within the fixed plate to be pressed or raised by a resilient force so as to be electrically connected to an external object; and rising preventing parts provided in the side plates to restrict a rising movement of the movable part so as to prevent the movable part from being separated from the fixed plate, wherein the bottom plate, the fixed plate, the side plates, and the front plate are coupled to each other by a convexo-concave structure to prevent a deformation of the connecting terminal device.

In accordance with another aspect of the present disclosure, there is provided a connecting terminal device provided in an electronic device, the connecting terminal device including: a substrate provided in the electronic device; a bottom plate fixed to the substrate; a fixed plate provided on the bottom plate; side plates provided on the bottom plate and opposite side surface of the fixed plate; a front plate provided on the front surface of the bottom plate, the fixed plate, and the side surfaces to be coupled thereto; a movable part connected to the rear surface of the fixed plate in a curved fashion and protruding to the outside within the fixed plate to be pressed or raised by a resilient force so as to be electrically connected to an external object; and rising preventing parts provided in the side plates to restrict a rising movement of the movable part so as to prevent the movable part from being separated from the fixed plate, wherein the bottom plate, the fixed plate, the side plates, and the front plate are coupled to each other by a convexo-concave structure to prevent a deformation of the connecting terminal device.

In accordance with another aspect of the present disclosure, there is provided a connecting terminal device including: a bottom plate; a fixed plate provided on the bottom plate; side plates provided on the bottom plate and opposite side surface of the fixed plate; a front plate provided on the front surface of the bottom plate, the fixed plate, and the side surfaces to be coupled thereto; a movable part connected to the rear surface of the bottom plate in a curved fashion and protruding to the outside within the fixed plate to be pressed or raised by a resilient force so as to be electrically connected to an external object; and rising preventing parts provided in the fixed plate and the movable part to restrict a rising movement of the movable part so as to prevent the movable part from being separated from the fixed plate, wherein the bottom plate, the fixed plate, the side plates, and the front plate are coupled to each other by a convexo-concave structure to prevent a deformation of the connecting terminal device.

In accordance with another aspect of the present disclosure, there is provided a connecting terminal device provided in an electronic device, the connecting terminal device including: a substrate provided in the electronic device; a bottom plate fixed to the substrate; a fixed plate provided on the bottom plate; side plates provided on the bottom plate and opposite side surface of the fixed plate; a front plate provided on the front surface of the bottom plate, the fixed plate, and the side surfaces to be coupled thereto; a movable part connected to the rear surface of the bottom plate in a curved fashion and protruding to the outside within the fixed plate to be pressed or raised by a resilient force so as to be electrically connected to an external object; and rising preventing parts provided in the fixed plate and the movable part to a restrict rising movement of the movable part so as to prevent the movable part from being separated from the fixed plate, wherein the bottom plate, the fixed plate, the side plates, and the front plate are coupled to each other by a convexo-concave structure to prevent a deformation of the connecting terminal device.

According to various embodiments of the present disclosure, by providing a pressing preventing part that supports a movable part between a bottom plate and a movable part and restricts a rising movement of the movable part at the same time in a protective wall that protects a front surface and side surfaces of the movable part, an influence of the pressing operation on a resilient part can be reduced even though a consistent and repeated pressing operation is applied to the movable part, a resilient force of the resilient part can be prevented or inhibited from being lowered or lost, and accordingly, a deformation inferiority and a connection inferiority of the product can be reduced.

Further, by providing a rising preventing part that restricts a rising movement of the movable part in the protective wall, the movable part can be prevented or resisted from being excessively raised, and the movable part can be prevented or resisted from being deformed even though an external force is applied from the lower side to the upper side of the movable part.

Furthermore, by coupling the bottom plate, a fixed plate, side plates, and a front plate with a convexo-concave structure, an external force transferred to the front side (for example, the Z axis direction) or to the front side (for example, the X axis direction) of the product can be easily dispersed by preventing a deformation of the product due to an external force.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
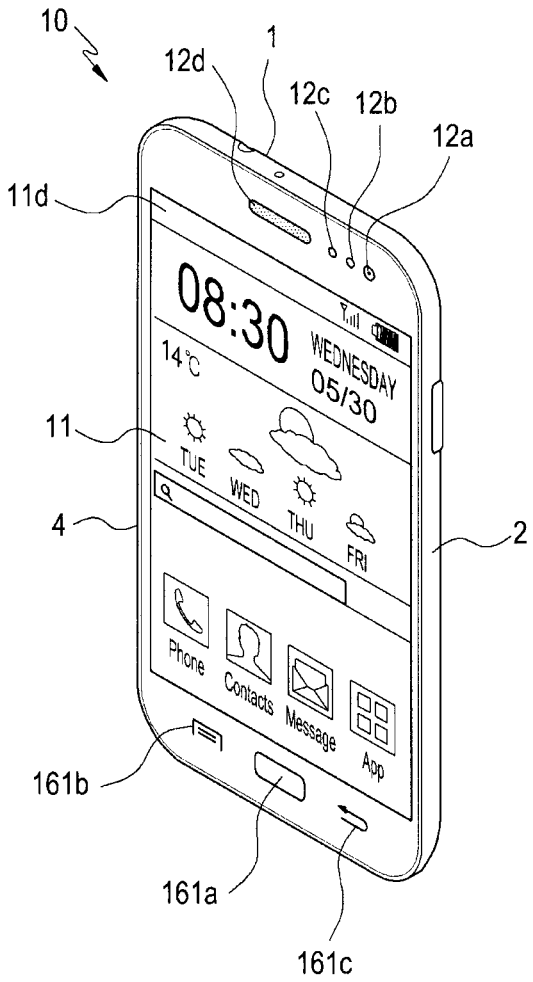
FIG. 1 is a perspective view illustrating the front surface of an electronic device including a connecting terminal device according to various embodiments of the present disclosure.

Hereinafter, various embodiments of the present disclosure will be described in detail. Firstly, terms used in the various embodiments of the present disclosure will be briefly described.

With respect to the terms in the various embodiments of the present disclosure, the general terms which are currently and widely used are selected in consideration of functions of structural elements in the various embodiments of the present disclosure. However, meanings of the terms may be changed according to an inventor's intention, a judicial precedent, appearance of a new technology, and the like. Further, in a certain case, a term arbitrarily selected by the applicant may be used. In such a case, the meaning of the term will be described in detail at the corresponding part in the description of the present disclosure. Thus, the terms used in various embodiments of the present disclosure should be defined based on the meanings of the terms and the overall contents of the embodiments of the present disclosure instead of simple titles of the terms.

Although the terms including an ordinal number such as first, second, etc. can be used for describing various elements, the structural elements are not restricted by the terms. The terms are used merely for the purpose to distinguish an element from the other elements. For example, a first element could be termed a second element, and similarly, a second element could be also termed a first element without departing from the scope of the present disclosure.

Here, application examples of the electronic device, according to an embodiment of the present disclosure, may include not only all mobile communication terminals operating based on communication protocols corresponding to various communication systems but also all information communication devices, multimedia devices, and application devices thereof, such as a video telephone, an e-book reader, a laptop personal computer (PC), a netbook computer, a personal digital assistant (PDA), a portable multimedia player (PMP), an MPEG-1 audio layer-3 (MP3) player, a mobile medical device, a camera, a wearable device (e.g., a head mounted device (HMD) such as electronic glasses, electronic clothing, an electronic bracelet, an electronic necklace, an electronic appcessory, an electronic tattoo, or a smart watch), and the like.

According to some embodiments, the electronic device may be a smart home appliance. For example, the smart home appliance may include at least one of a television, a digital video disk (DVD) player, an audio, a refrigerator, an air conditioner, a vacuum cleaner, an oven, a microwave oven, a washing machine, an air cleaner, a set-top box, a TV box (e.g., Samsung HomeSync™, Apple TV™, or Google TV™), a game console, an electronic dictionary, an electronic key, a camcorder, and an electronic photo frame.

According to another embodiment, the electronic devices may include at least one of various medical devices (e.g., a magnetic resonance angiography (MRA), a magnetic resonance imaging (MRI), a computed tomography (CT) machine, and an ultrasonic machine), navigation devices, global positioning system (GPS) receivers, event data recorders (EDR), flight data recorders (FDR), vehicle infotainment devices, electronic devices for ships (e.g., navigation devices for ships, and gyro-compasses), avionics, security devices, automotive head units, robots for home or industry, automatic teller's machines (ATMs) in banks, or point of sales (POS) in shops.

According to some embodiments, the electronic device may include at least one of furniture or a part of a building/structure, an electronic board, an electronic signature receiving device, a projector, and various types of measuring devices (for example, a water meter, an electric meter, a gas meter, a radio wave meter and the like) including a camera function.

An electronic device including a plurality of components according to various embodiments of the present disclosure may be a combination of one or more of the above described various devices. Also, an electronic device according to various embodiments of the present disclosure may be a flexible device. Also, an electronic device according to various embodiments of the present disclosure is not limited to the above described devices.

Figure 2:
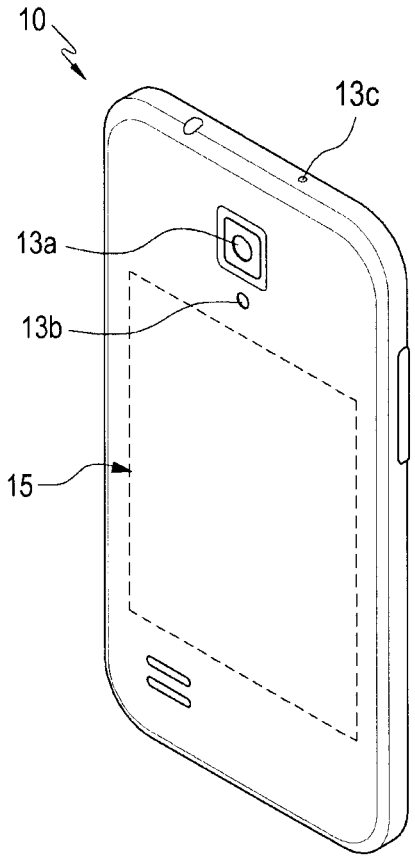
FIG. 2 is a perspective view illustrating the rear surface of an electronic device including a connecting terminal device according to various embodiments of the present disclosure.

FIG. 1 is a perspective view illustrating the front surface of an electronic device. FIG. 2 is a perspective view illustrating the rear surface of the electronic device. The electronic device 10 may be a smartphone or a wearable device includes a housing having an upper surface 1 and side surfaces 2 and 4. Hereinafter, a configuration of an electronic device, such as a smartphone, will be described with reference to FIGS. 1 and 2.

As illustrated in FIG. 1, a touch screen 11 may be disposed at the center of the front surface of the electronic device 10. The touch screen 11 may occupy most of the front surface of the electronic device 10. FIG. 1 illustrates an example in which a main home screen is displayed on the touch screen 11. The main home screen is the first screen that is displayed on the touch screen 11 when the electronic device 10 is switched on. When the electronic device 10 has several pages of different home screens, the main home screen may be the first of several pages of home screens. Short-cut icons for executing frequently used applications, a main menu switching keys, time, weather, and the like may be displayed on the main home screen. The main menu switching key may display a menu screen on the touch screen 11. A status bar 11*d* for displaying statuses, such as a battery charging status, strength of a received signal, and current time, may also be formed on the upper end of the touch screen 11. A home key 161*a*, a menu button 161*b*, and a back button 161*c* may be formed on the lower side of the touch screen 11.

The home key 161*a* may display the main home screen on the touch screen 11. For example, when the home key 161*a* is touched while any home screen different from the main home screen or the menu screen is displayed, the main home screen may be displayed on the touch screen 11. Further, when the home key 161*a* is touched while applications are being executed on the touch screen 11, the main home screen may be displayed on the touch screen 11. Also, the home key 161*a* may also be used to display recently used applications or a task manager on the touch screen 11. The menu button 161*b* may provide a connectivity menu, which may be used on the touch screen 11. The connectivity menu may include a widget addition menu, a background switching menu, a search menu, an editing menu, and an environment setting menu. The back button 161*c* may display the screen executed shortly before the currently executed screen, or may terminate the most recently used application.

According to various embodiments of the present disclosure, a first camera 12*a*, an illumination intensity sensor 12*b*, a proximity sensor 12*c*, or a speaker 12*d* may be disposed on an upper end portion of the front surface of the electronic device 10. A second camera 13*a*, a flash 13*b*, or a speaker 13*c* may be provided on the rear surface of the electronic device 10. If the electronic device 10 is configured such that a battery pack is detachable, the bottom surface of the electronic device 10 may be a detachable battery cover 15.

The electronic device 10 that will be described below may be any one of a wearable device, a notebook, a netbook, a smartphone, a tablet PC, a galaxy tab, and an i-Pad. In the embodiment of the present disclosure, the electronic device 10 may be a smartphone.

In addition, the design of the display unit of the electronic device may be implemented more luxuriously while a bezel area is minimized or the display unit is made larger, a flexible display unit may be provided, or a convex or concave display unit may be implemented.

For example, a peripheral portion of the display unit is bent such that the view area may be enlarged to a side surface of the electronic device. As the view area of the display unit is bent to be enlarged to the side surface of the electronic device, the view area may be enlarged or a separate screen may be used on the side surface, and the design of the display unit may be implemented luxuriously. According to an embodiment of the present disclosure, the display unit includes a first view area and a second view area provided on opposite side surfaces of the first screen area.

The above-mentioned electronic device 10 includes a connecting terminal device 200 (see FIG. 4) on a substrate 270 (see FIG. 7) provided in the electronic device, and the connecting terminal device may include a connecting terminal electrically connected to an external object. A connecting terminal provided for the above-mentioned electronic device will be exemplified in the present embodiment, but the present disclosure is not limited thereto. For example, any electrically connected connecting terminal may be applied to another device other than the disclosed electronic devices as the connecting terminal device. Here, in various embodiments of the present disclosure, a connecting terminal device provided for an electronic device that may perform communication will be described.

Figure 3:
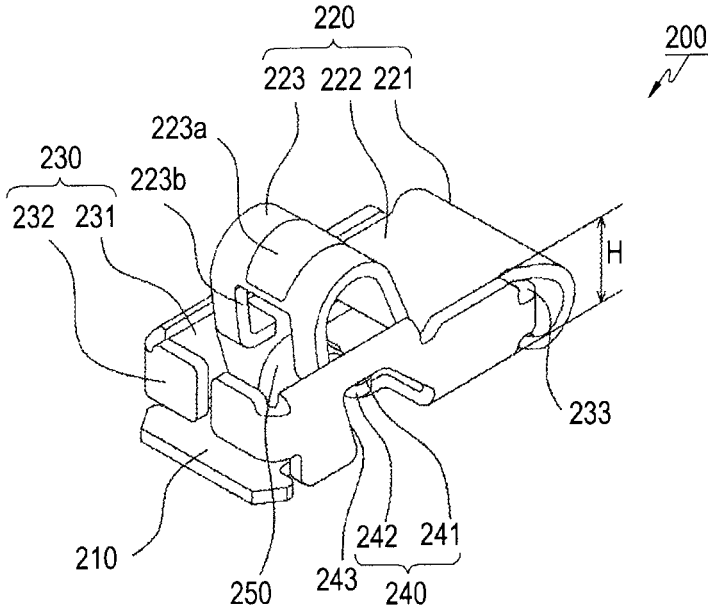
FIG. 3 is a perspective view illustrating a configuration of a connecting terminal device according to various embodiments of the present disclosure.
Figure 4:
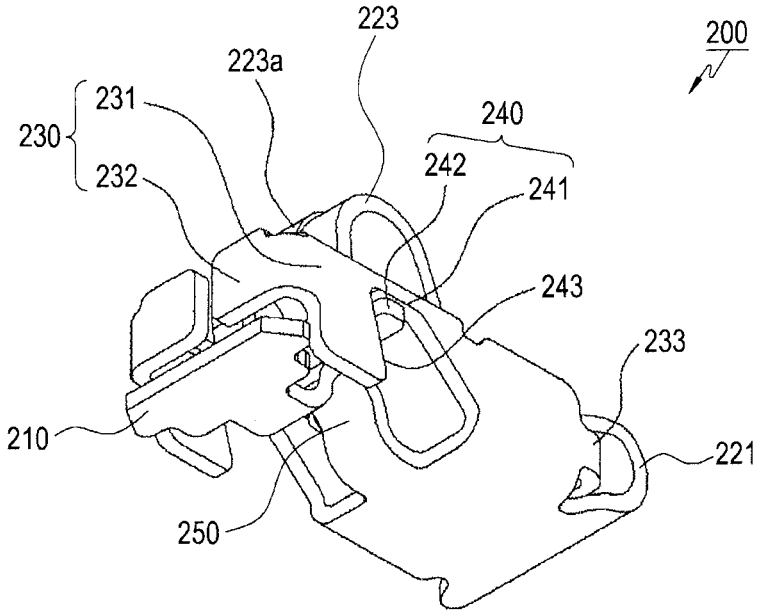
FIG. 4 is a perspective view illustrating the rear surface of a connecting terminal device according to various embodiments of the present disclosure.
Figure 5:
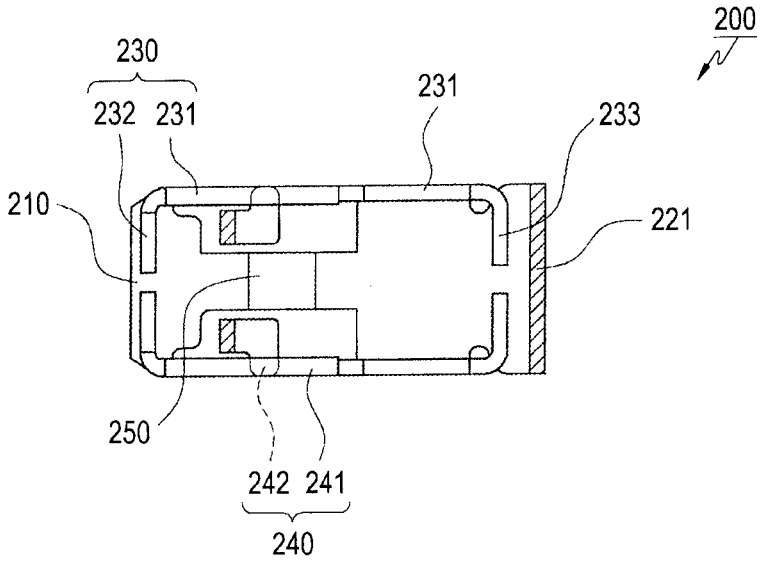
FIG. 5 is a plan view illustrating the rear surface of a connecting terminal device according to various embodiments of the present disclosure.

FIG. 3 is a perspective view illustrating a configuration of a connecting terminal device 200 according to various embodiments ('a first embodiment') of the present disclosure. FIG. 4 is a perspective view illustrating the rear surface of a connecting terminal device 200 according to various embodiments of the present disclosure. FIG. 5 is a plan view illustrating the rear surface of a connecting terminal device 200 according to various embodiments of the present disclosure.

Referring to FIGS. 3 to 5, the connecting terminal device 200 provided in the electronic device 10 includes a bottom plate 210, a movable part 220, one or more protective walls 230, a pressing preventing part 233, a rising preventing part 240, and a stopper 250.

The bottom plate 210 is adapted to be fixed to a substrate 270 (see FIG. 7) provided in the electronic device 10 (see FIG. 1).

Figure 7:
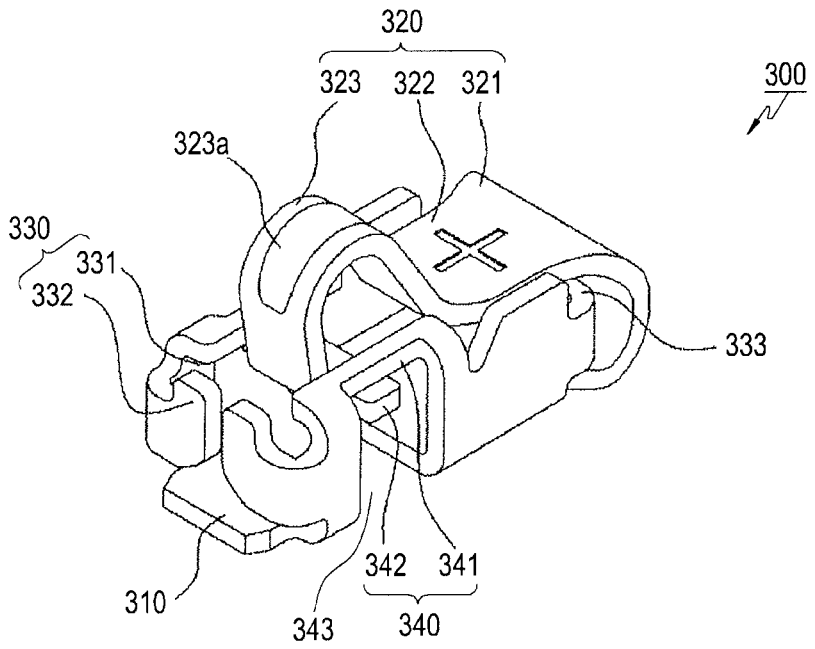
FIG. 7 is a perspective view illustrating a configuration of a connecting terminal device according to another embodiment of the present disclosure.

The movable part 220 is connected to the rear surface of the bottom plate 210 in a curved way to be pressed by a resilient force or raised so as to be electrically connected to an external object 260 (see FIG. 7).

The protective walls 230 is provided along the side surfaces of the bottom plate 210 to protect the movable part 220.

The pressing preventing parts 233 are provided between the bottom plate 210 and the movable part 220, and may be provided ends of the protective walls 230 to restrict pressing movement of the movable part 220 while making contact with the movable part 220 as the movable part 220 is pressed.

The rising preventing parts 240 are provided on side surfaces of the protective walls 230 to restrict rising movement of the movable part 220, thereby preventing a separation of the movable part 220 from the protective walls 230.

The stopper 250 is additionally provided on the bottom plate 210 to restrict a movement of the connecting part 223 provided in the movable part 220 in a pressing direction.

A stopper recess 223*b* may be formed on the front surface of the connecting part 223 such that the connecting part 223 is moved together with the movable part 220 as the movable part 220 is moved to insert or separate the stopper 250.

For example, the connecting part 223 is pressed as the movable part 220 is pressed, and the stopper 250 restricts movement of the connecting part 223 in a pressing direction at the same time when the stopper recess 223*b* of the connecting part 223 is inserted into and mounted on the stopper 250 provided on the bottom plate 210.

Here, the stopper 250 may have an 'n' shape. In the embodiment of the present disclosure, the stopper 250 may have another shape other than an 'n' shape. For example, various modifications may be applied to the stopper 250 as long as it may be inserted into, and separated from, the stopper recess 223*b*.

A resilient force may prevent or inhibit the movable part 220 from being lowered or lost even though the movable part 220 is repeatedly pressed and raised, and accordingly, a deformation error and a connection error of the product may be prevented, by forming the pressing preventing parts 233 that restricts a pressing of the movable part 220 on the protective wall 230, forming the rising preventing parts 240 that restrict a rising of the movable part 220 on the protective wall 230, and additionally forming the stopper 250 that restricts a movement of the movable part 220 in the pressing direction on the bottom plate 210.

Furthermore, the movable part 220 includes a resilient part 221, a connecting part 223, and an absorbing part 222. The resilient part 221 may be connected to the rear surface of the bottom plate to be rounded upwards to provide a resilient force so that the movable part 220 is raised. For example, the resilient part 221 is formed to have a U shape. The connecting part 223 extends upwards from the resilient part 221 by a predetermined height to be electrically connected to the external object. For example, the connecting part 223 protrudes from an upper portion of the protective wall 230 and is exposed to the outside at the same time. The absorbing surface 222 is provided between the resilient part 221 and the connecting part 223 to extend so as to integrally connect the resilient part 221 and the connecting part 223 and to support the connecting part 223 at the same time.

The resilient part 221 is roundly bent in an elliptical or semi-elliptical shape. Although it is described in the embodiment of the present disclosure that the resilient part 221 has the disclosed shape, the present disclosure is not limited thereto. For example, any shape that provides a resilient force for the movable part 220 may be variously applied as the resilient part 221. For example, the resilient part 221 may have a circular or semi-circular shape.

The pressing preventing part 233 may be situated on the inside of the resilient part 221. For example, the pressing preventing part 233 is situated on the inside of the resilient part 221 and is provided below the absorbing surface 222.

The protective wall 230 includes side walls 231 and a front wall 232. The side walls 231 are formed on opposite surfaces of the bottom plate 210 to be bent vertically and horizontally to protect the side surfaces of the movable part 220. The front wall 232 is formed on a front surface of the bottom plate 210 to be bent at the right angle so as to protect the front surface of the movable part 220.

The pressing preventing parts 233 may be shaped to be bent vertically on side surfaces of ends of the side walls 231, and include side supports to make contact with the movable part 220 as the movable part 220 is pressed.

For example, the side walls 231 are formed on the opposite side surfaces of the bottom plate 210, and ends of the side walls 231 are vertically bent to face each other so as to form the pressing preventing parts 233.

The rising preventing part 240 includes a cutaway portion 243, a stop portion 242, and a latch 241. The cutaway portions 243 are formed on the side walls 231 to form the stop portions 242. The stop portions 242 are formed in the cutaway portions 243 to be stopped by, or released from, the latches 241. The latch 241 extends to the widthwise outside of the connecting part 223 and is formed at one end of the connecting part 223 to be stopped by, or released from, the stop portion 242. The cutaway portion 243 is cut away to continuously extend from a portion of the side wall 231 where the connecting portion 223 is situated to all the side wall 231 and the bottom plate 210 except for an upper end portion of the side wall 231.

Furthermore, the protective wall 230 may be a tunnel type protective wall 230 that is divided forward and rearwards through the cutaway portions 243. The protective wall 230 is configured such that a lower end portion of the side wall 231, which is situated on the front side of the cutaway portion 243, extends to the bottom plate 210 to be soldered to the substrate 270 (see FIG. 7).

In this state, an operational process of the connecting terminal device 200 provided in the electronic device 10 will be described in more detail as follows.

Referring back to FIGS. 3 and 4, the connecting terminal device 200, according to the present disclosure, further includes a bottom plate 210 that is fixed to the substrate 260 (see FIG. 6), and protective walls 230 that interrupt external forces applied from the front surface and side surfaces of the connecting terminal device 200 while the movable part 220 that is moved upwards and downwards as it is connected to the external object 270 (see FIG. 6) to form a basic structure of the connecting terminal device 200 in a C-clip form as a whole. In particular, the protective wall 230 may be provided with a rising preventing part 240 that restricts the pressing preventing part 233 that restricts the movable part 220 from being excessively pressed downwards and the movable part 220 from being excessively raised upwards.

The movable part 220 is moved upwards and downwards when being connected to or released from the external object in a structure in which the movable part 220 forms a free end shape where one end of the movable part 220 is not fixed while being bent upwards from the rear surface of the bottom plate 210 to face the bottom plate 210. The movable part 220 is configured such that the resilient part 221, the absorbing surface 222, and the connecting part 223 continuously extend from the rear surface of the bottom plate 210.

The resilient part 221 forms a semi-circular or semi-elliptical form that is roundly bent upwards while having a predetermined radius of curvature on the rear surface of the bottom plate 210 to function to be resiliently deformed when the external object 260 (see FIG. 6) is connected to the connecting part 223 and to restore the connecting part 223 to the original position when the external object 260 is released from the connecting part 223.

The absorbing surface 222 horizontally extends from an end portion of the resilient part 221 in parallel to the bottom plate 210. The absorbing surface 222 provides an area that is absorbed by an absorbing nozzle (not illustrated) during an SMD process of mounting the connecting terminal device 200 on the substrate 270 (see FIG. 6) while horizontally connecting the resilient part 221 and the connecting part 223.

The connecting part 223 is a part that makes direct contact with the external object 260 (see FIG. 6), and an upper end of the connecting part 223 has a convex semi-circular or semi-elliptical shape, and an end portion thereof extends towards the bottom plate 210 in the state in which the connecting part 223 has a predetermined radius of curvature while taking a posture in which it is upwardly inclined at an end of the absorbing surface 222 horizontally extending from the resilient part 221.

An embossed portion 223*a* protruding to have a flat surface of a predetermined area is formed on the upper surface of the connecting part 223, and because the connecting part 223 makes contact with the external object 260 (see FIG. 6) through a flat surface having a predetermined area, for example, the embossed portion 223*a*, a sufficient contact area may be secured, and accordingly, connecting performance may be improved.

The absorbing surface 222 and the connecting part 223 are parts that are continuously connected from the resilient part 221, but has a width smaller than that of the resilient part 221. Because the absorbing surface 222 and the connecting part 223 are situated between the protective walls 230 even though the protective walls 230 are vertically bent from the opposite side surfaces of the bottom plate 210, the protective walls 230 are not interfered so that the movable part 220 is naturally moved during the movement of the movable part 220.

The protective walls 230 may be vertically bent upwards from the bottom plate 210 by a predetermined height to function to interrupt an external force applied to the movable part 220, and include side walls 231 that protect the side surfaces of the movable part 220 and front walls 232 that protect the front surface of the movable part 220.

The side walls 231 may be vertically bent from the opposite widthwise ends of the bottom plate 210, and block the entire length of the movable part 220 except for the resilient part 221. Then, the side walls 231 extend by the same height H as the height of the absorbing surface 222 that forms the movable part 220. Because the upper surfaces of the side walls 231 and the absorbing surface 222 have the same height, the operator may easily identify the flatness of the absorbing surface 222 (for example, the horizontal plane of the absorbing surface 222) by the naked eye.

This is because it is important to horizontally manufacture the absorbing surface 222 since the nozzle cannot be easily absorbed during an SMD process when the absorbing surface 222 does not form a horizontal plane.

The front walls 232 are vertically bent from ends of the front surface of the side walls 231 towards the inside of the connecting terminal device to block the front side of the connecting part 223.

The protective walls 230 include a pair of side walls 231 disposed on the opposite side surfaces of the bottom plate 210, and a pair of front walls 232 vertically bent from the front sides of the side walls 231 and disposed on the left and right sides to face each other symmetrically.

The protective walls 230 have a height by which the movable part 220 is sufficiently blocked. Preferably, the protective walls 230 have a height higher than the absorbing surface 222 that is horizontal with the movable part 220 to cover the front end of the connecting part 223.

The present disclosure can protect the movable part 220 from an external force applied in several directions of the connecting terminal device 200 through the above-described protective walls 230, and can reduce deformation of the resilient part 221 due to a consistent and repeated pressing operation to prevent the resilient part 221 from lowering or losing a resilient force in advance at the same time.

To this end, the above-mentioned protective wall 230 may include a pressing preventing part 233 that is situated below the movable part 220 to restrict excessive pressing of the movable part 220.

Accordingly, by allowing the pressing preventing parts 233 extending from the side walls 231 to support the upper side of the resilient part 221 when the movable part 220 is pressed, the resilient force of the resilient part 221 can be prevented from being lowered as an influence of the pressing operation on the resilient part 221 is reduced even though a force is applied to the movable part 220 consistently and repeatedly.

A pair of pressing preventing parts 233 are disposed on the left and right sides inside the resilient part 221 in a form in which they are vertically bent on the rear sides of the side walls 231 disposed on the opposite side surfaces of the bottom plate 210 to face each other symmetrically. Accordingly, the resilient part 221 may be supported by a pair of left and right pressing preventing parts 233 while being balanced leftwards and rightwards.

Then, it is preferable that the pressing preventing parts 233 have a height that does not influence a normal movement of the movable part 220 while being situated below the resilient part 221 at a height lower than the other parts of the side walls 231.

Meanwhile, as described above, rising preventing parts 240 are disclosed herein that may prevent the movable part 220 from being excessively raised on side surfaces of the protective walls 230.

For example, the rising preventing parts 240 are pressed downwards from the upper side of the connecting part 223 when the external object 260 (see FIG. 6) makes contact with the connecting part 223, in which case the connecting part 223 is raised upwards by the resilient force of the resilient part 221 when the external object deviates from the connecting part 223 and the connecting part 223 is stopped by the protective walls 230 so that the rising preventing part 240 can be prevented from deviating from the protective walls 230 by preventing the movable part 220 from being excessively raised upwards.

The rising preventing part 240 may include a stop portion 242 formed on the protective wall 230 and a latch 241 formed in the connecting part 223.

The stop portion 242 may be formed through a cutaway portion 243 that is cut away upwards and downwards from one side of the side wall 231 where the connecting part 223 is situated to the entire height direction except for an upper end portion of the side wall 231. For example, the stop portion 242 is a configuration that forms the upper side of the cutaway portion 243 that is cut away upward and downward to one side of the side wall 231 where the connecting part 223 is situated; for example, a configuration that corresponds to the upper end portion of the side wall 231 that is not cut away.

The cutaway portion 243 may be cut away to continuously extend to all of the side wall and the bottom plate 210. Accordingly, the connecting terminal device 200 is configured such that the side walls 231 and the bottom plate 210 are divided forward and downwards with respect to the cutaway portions 243.

A lower end of the side wall 231 may be situated on the front side of the cutaway portion 243 extends to the bottom 210 and is soldered to the substrate 270 (see FIG. 6) during SMD mounting. In this way, both the divided front and rear sides of the protective wall 230 are soldered and fixed to the substrate, and the latch 241 may be fixed more firmly.

The latch 241 horizontally extends by a predetermined length from an end of the connecting part 223 towards an outer widthwise side of the connecting part 223, for example, towards the side wall 231. The opposite ends of the latches 241 are situated at the cutaway portions 243 below the stop parts 242.

According to the present disclosure, because the connecting part 223 and the side walls 231 are stopped by each other, the latches 241 of the connecting part 223 is stopped by lower portions of the stop portions 242 of the side walls 231, for example, through the rising preventing parts 240 including the stop portions 242 and the latches 241 after the movable part 220 rises by a predetermined height so that further rising of the movable part 220 can be restricted and excessive rising of the movable part 220 can be prevented. For example, because the latches 241 of the connecting part 223 is raised and stopped by the stop portions 242, the connecting part 223 can be prevented from deviating from the side walls 231.

Furthermore, because the latches 241 may be provided at ends of the connecting part 223 may be easily identified from the outside through the cutaway portions 243 that define opening portions of the side walls 231, the location of an end of the movable part 220 can be easily identified.

For example, although the location of an end of the movable part 220 cannot be easily identified from the outside when the movable part 220 is surrounded by the protective walls 230, the cutaway portions 243 of the side walls 231 for implementing the stop portions 242 may function as opened windows in the embodiment of the present disclosure, and then because the latches 241 forming the ends of the connecting part 223 are situated in the cutaway portions 243, the operator may easily identify a failure of the connecting terminal device 200 through the location of an end of the movable part 220.

For example, when the latches 241 defining ends of the connecting part 223 are situated close to the stop portions 242 defining the upper surfaces of the cutaway portions 243, the product may be determined as a normal product that can secure a sufficient movement distance, and when the latches 241 are situated far below from the cutaway portion 243, the product may be easily determined as an inferior product that cannot secure a sufficient movement distance.

Meanwhile, in various embodiments of the present disclosure, a stopper 250 and 50 for preventing the movable part 220 from being excessively pressed when an abnormal external force is applied to the movable part 220 is further provided.

For example, the stopper is a portion that supports the connecting part 223 from the lower side, and is integrally bent from the bottom plate 210 to have an n shape when viewed from the bottom plate 210 directly below the connecting part 223 as a whole.

Accordingly, when the movable part 220 is excessively lowered by an abnormal external force applied to the movable part 220, descending of the movable part 220 is restricted as the connecting part 223 is stopped by an upper end of the stopper 250.

The stopper 250 may be bent to the entire width of the bottom plate 210, but it is preferable that the stopper 250 has a width smaller than the width of the bottom plate 210 to be easily bent without being interfered by the side walls 231.

A stopper recess **223*b*, which is cut away upwards and downwards while the widthwise center of the connecting part 223 is opened to prevent an interference of the stopper 250, is formed on the front surface of the connecting part 223. Accordingly, the connecting part 223 may be naturally moved without being interfered by the stopper 250 through the stopper recess 223*b* during movement of the connecting part 223**.

Then, the latches 241 may be provided in the connecting part 223 horizontally extend from the opposite ends of the connecting part 223 defining opposite surfaces of the stopper recess 223*b* towards the side walls 231.

Hereinafter, an operation of connecting the above-configured connecting terminal device 200, according to various embodiments ('a first embodiment) of the present disclosure, to an external object will be described.

Figure 6A:
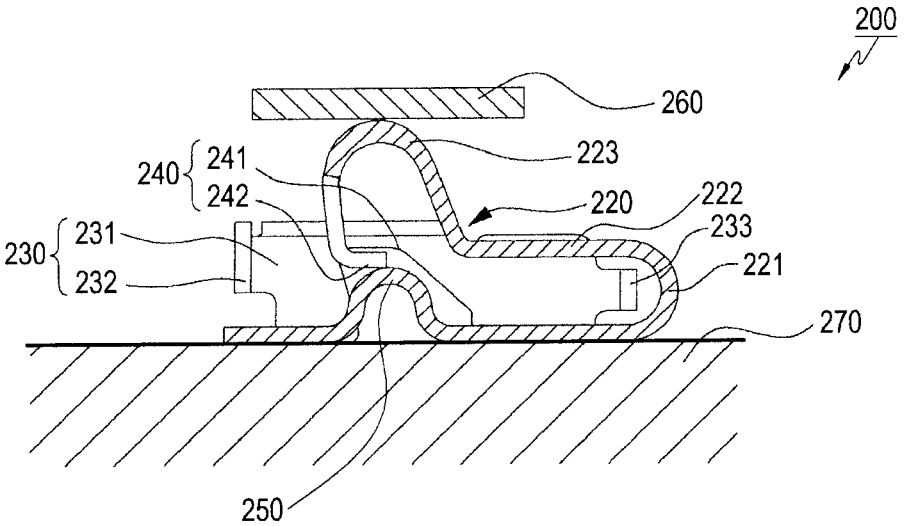
FIG. 6A, FIG. 6B and FIG. 6C are side sectional views illustrating an operational state of a connecting terminal device according to various embodiments of the present disclosure.
Figure 6B:
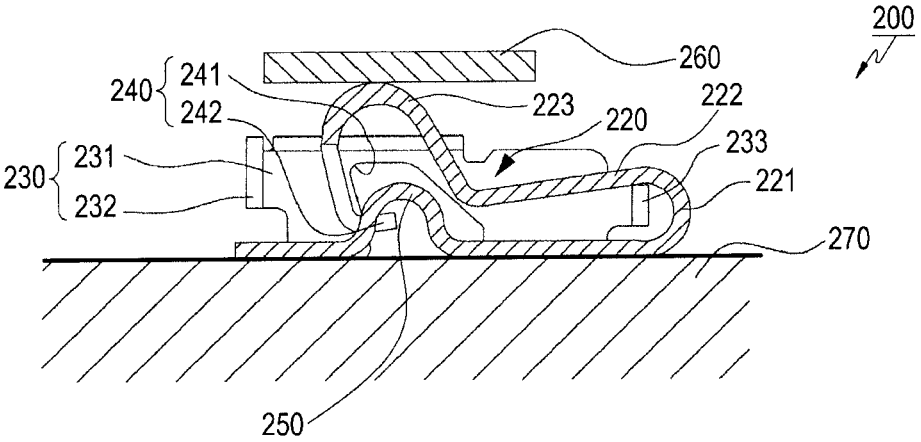
Figure 6C:
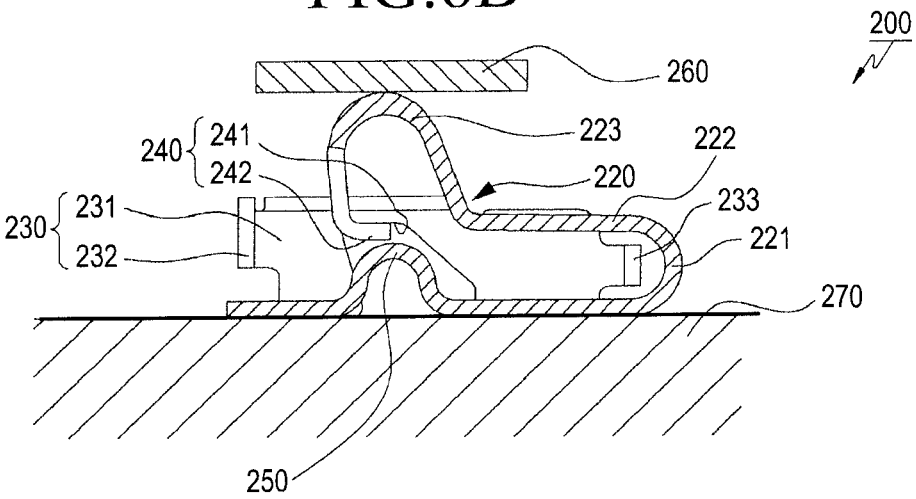

FIG. 6A illustrates an initial connection time point of the connecting terminal device 200, FIG. 6B illustrates a connection state of the connecting terminal device 200, and FIG. 6C illustrates a state in which the connecting terminal device 200 is prevented from being excessively raised.

In the initial time point of FIG. 6A, the connecting terminal device 200 is soldered and fixed to the substrate through the bottom plate 210 while the entire connecting terminal device 200 is exposed to the outside, and is initially connected to an external object, for example, an external object such as an NFC antenna that is embedded on the rear cover of a smartphone.

At a time point (connection time point) of FIG. 6B, the movable part 220 of the connecting terminal device 200 that is mounted on the substrate is moved downwards by a predetermined height while connecting the connecting part 223 and the external object. Then, the resilient part 221 is resiliently deformed while absorbing an external force transferred to the connecting part 223, and is supported by the upper ends of the pressing preventing parts 233 bent at the rear ends of the side walls 231 at a time point when the movement of the movable part 220 is completed.

Accordingly, by allowing the pressing preventing parts 233 to support the upper side of the resilient part 221 when the movable part 220 is pressed due to the connection of the external object and the connecting part 223, the resilient force of the resilient part 221 can be prevented from being lowered as an influence of the pressing operation on the resilient part 221 is reduced even though a force is applied to the movable part 220 consistently and repeatedly.

Further, in the connection state of FIG. 6B, because the movable part 220*b* is lowered while being supported by the pressing preventing part 233 even when the movable part 220 is further lowered as an abnormal external force is applied to the movable part 220, for example, an abnormal external force, such as an impact caused by the smartphone that drops to the ground surface, is applied, an influence of the abnormal external force applied to the movable part 220 on the resilient part 221 can be reduced, and accordingly, an excessive deformation of the resilient part 221 can be prevented. In this state, the movable part 220 that is situated on the front side of the pressing preventing parts 233 while taking the pressing preventing parts 233 as support points is further lowered downwards so that a further downward movement of the movable part 220 is restricted while being stopped by an upper end of the stopper 250.

Meanwhile, as illustrated in FIG. 6C, when an external force is applied to the connecting part 223 from the lower side to the upper side by the resilient part 221, because the rising preventing parts 240 that restrict rising movement of the movable part 220 are provided on the side surfaces of the protective walls 230 and each of the rising preventing parts 240 includes the cutaway portion 243, the stop portion 242, and the latch 241, the movable part 220 rises by a predetermined height and the latches 241 provided at ends of the connecting part 223 are stopped by the lower sides of the stop portions 242 that defines the upper surfaces of the cutaway portions 243 on the side walls 231 so that a further rising movement of the movable part 220 can be suppressed and the movable part 220 can be prevented from being excessively raised.

In this way, because the present disclosure includes the pressing preventing parts 233 that prevent excessive rising of the movable part 220 and the rising preventing parts 240 that prevent excessive rising of the movable part 220 on the protective walls 230 that protect the front surface and the side surfaces of the movable part 220, the connection terminal device 200 can be prevented from being deformed by an external force applied to all sides of the connection terminal device and further the resilient force of the resilient part 221 can be prevented from being lowered or lost, so that a deformation inferiority of the product may be prevented.

According to various embodiments of the present disclosure, as illustrated in FIG. 3, a connecting terminal device may include: a bottom plate; a movable part provided on a rear surface of the bottom plate to be electrically connected to an external object as the movable part is pressed or raised; one or more protective walls provided on side surfaces of the bottom plate; pressing preventing parts provided at ends of the protective walls and provided between the bottom plate and the movable plate to restrict pressing movement of the movable part; and rising preventing parts provided on side surfaces of the protective walls to restrict rising movement of the movable part.

According to various embodiments of the present disclosure, a connecting terminal device may include: a bottom plate; a movable part connected to a rear surface of the bottom plate in a curved fashion and pressed or raised by a resilient force to be electrically connected to an external object; one or more protective walls provided on side surfaces of the bottom plate to protect the movable part; pressing preventing parts provided at ends of the protective walls and provided between the bottom plate and the movable plate to make contact with the movable plate as the movable plate is pressed, restricting pressing movement of the movable part; rising preventing parts provided on side surfaces of the protective walls to prevent rising movement of the movable part so as to prevent the movable part from being separated from the protective walls; and a stopper provided on the bottom plate to restrict movement of the movable part in a pressing direction.

According to various embodiments of the present disclosure, the movable part may include: a resilient part connected to the rear surface of the bottom plate to be roundly curved upwards to provide a resilient force such that the movable part is pressed or raised; a connecting part extending from the resilient part upwards by a predetermined height to be electrically connected to the external object; and an absorbing surface provided between the resilient part and the connecting part and extending such that the resilient part and the connecting part are integrally connected to each other.

According to various embodiments of the present disclosure, the resilient part may be roundly bent upwards in an elliptical or a semi-elliptical shape, and the pressing preventing parts may be situated inside the resilient part.

According to various embodiments of the present disclosure, the protective walls may include: side walls formed on opposite surfaces of the bottom plate to be vertically and horizontally bent to protect side surfaces of the movable part; and a front wall formed on the front surface of the bottom plate to be vertically bent to protect the front surface of the movable part.

According to various embodiments of the present disclosure, the pressing preventing parts may include side supports formed on side surfaces of ends of the side walls to be vertically bent to make contact with the movable part as the movable part is pressed.

According to various embodiments of the present disclosure, the rising preventing parts may include: cutaway portions formed on the side walls; stop portions formed in the cutaway portions; and latches formed at ends of the connecting part and extending to the outer widthwise side of the connecting party to be stopped by or released from the stop portions.

According to various embodiments of the present disclosure, the cutaway portions may be cut away to be continuously connected to the side walls and the entire bottom plate except for upper end portions of the side walls at portions of the side walls where the connecting part is situated.

According to various embodiments of the present disclosure, a stopper recess into and from which the stopper is inserted and separated when the connecting part is moved may be formed on a front surface of the connecting part.

According to various embodiments of the present disclosure, the stopper may have an inverse U-shape.

According to various embodiments of the present disclosure, the protective walls may be tunnel type protective walls divided forwards and rearwards through the cutaway portions, and the protective walls may be fixedly soldered to the substrate as lower end portions of the side walls situated on the front side of the cutaway portions extend to the bottom plate.

According to various embodiments of the present disclosure, a connecting terminal device may include: a bottom plate; one or more protective walls provided on side surfaces of the bottom plate to protect the movable part; pressing preventing parts provided at ends of the protective walls and provided between the bottom plate and the movable part to make contact with the movable part as the movable part is pressed so as to be connected to the rear surface of the bottom plate in a curved fashion, so that the pressing preventing parts are pressed or raised by a resilient force such that the pressing movement of the movable part that is electrically connected to the external object is restricted; and rising preventing parts provided on side surfaces of the protective walls to prevent rising movement of the movable part so as to prevent the movable part from being separated from the protective walls.

Figure 8:
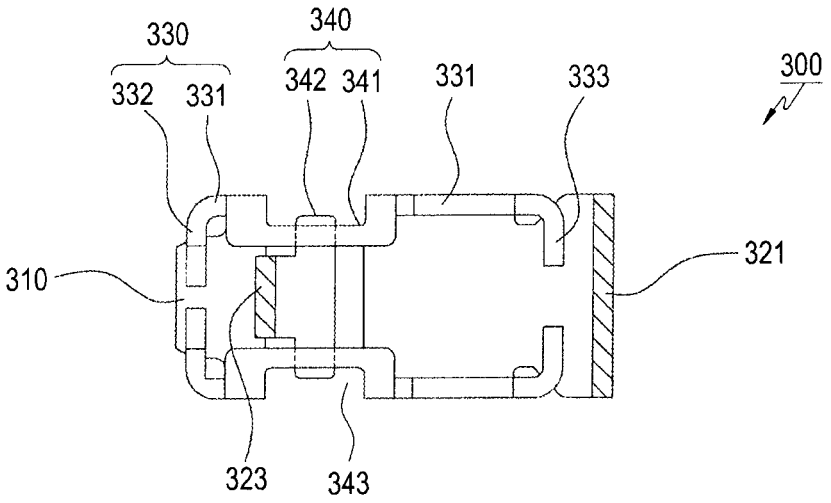
FIG. 8 is a plan view illustrating a configuration of a connecting terminal device according to another embodiment of the present disclosure.

FIG. 7 is a perspective view illustrating a configuration of a connecting terminal device 300 without a stopper 250 (see FIG. 4) according to various embodiments ('a second embodiment') of the present disclosure. FIG. 8 is a plan view illustrating a configuration of a connecting terminal device 300 without a stopper 250 (see FIG. 4) according to another embodiment of the present disclosure.

Referring to FIGS. 7 to 8, the connecting terminal device 300 provided in the electronic device 10 may include a bottom plate 310, a movable part 320, one or more protective walls 330, a pressing preventing part 333, and a rising preventing part 340.

The bottom plate 310 is adapted to be fixed to a substrate 370 (see FIG. 9) provided in the electronic device 10 (see FIG. 1).

The movable part 320 is connected to the rear surface of the bottom plate 310 in a curved way to be pressed by a resilient force or raised so as to be electrically connected to an external object 360 (see FIG. 9).

The protective walls 330 are provided along the side surfaces of the bottom plate 310 to protect the movable part 320.

The pressing preventing parts 333 are provided between the bottom plate 310 and the movable part 320, and may be provided on ends of the protective walls 330 to restrict pressing movement of the movable part 320 while making contact with the movable part 320 as the movable part 220 is pressed.

The rising preventing parts 340 are provided on side surfaces of the protective walls 330 to restrict rising movement of the movable part 320, thereby preventing separation of the movable part 320 from the protective walls 330.

In this way, additionally, a resilient force may be prevented from being lowered orb lost even though the movable part 320 is repeatedly pressed and raised, and accordingly, a deformation error and a connection error of the product may be prevented, by forming the pressing preventing parts 333 that restricts pressing of the movable part 320 on the protective wall 330 without a stopper 250 (see FIG. 4), and forming the rising preventing parts 340 that restricts rising of the movable part 320 on the protective wall 330.

Further, because the movable part 320 includes a resilient part 321, a connecting part 323, and an absorption surface 322 and the configurations of the movable part 320 have been described in the various embodiments ('the first embodiment') of the present disclosure, a detailed description thereof will be omitted.

The pressing preventing part 333 is situated on the inside of the resilient part. For example, the pressing preventing part 333 is situated on the inside of the resilient part 321 and is provided below the absorbing surface 322.

The protective wall 330 includes side walls 331 and a front wall 332.

The side walls 331 are formed on opposite surfaces of the bottom plate 310 to be bent vertically and horizontally to protect the side surfaces of the movable part 320.

The front wall 332 is formed on a front surface of the bottom plate 310 to be bent at the right angle so as to protect the front surface of the movable part 320.

The pressing preventing parts 333 are bent vertically on side surfaces of ends of the side walls 331, and include side supports to make contact with the movable part 320 as the movable part 320 is pressed.

For example, the side walls 331 are formed on the opposite side surfaces of the bottom plate, and ends of the side walls 331 are vertically bent to face each other so as to form the pressing preventing parts 333.

The rising preventing part 340 includes a cutaway portion 343, a stop portion 341, and a latch 342. The cutaway portions 343 are formed on the bottom plate 310 and the side walls 331 to form the stop portions 341. The stop portions 341 are formed in the cutaway portions 342 to be stopped by, or released from, the latches 343. The latch 342 extends widthwise to the outside of the connecting part 323 and is formed at one end of the connecting part 323 to be stopped by, or released from, the stop portion 341.

The cutaway portions 343 has divided recesses to divide the bottom plate 310 and the side walls 331 forwards and rearwards. For example, the divided recesses may be tunnel type recesses that are formed between the bottom plate 310 and the side walls 331 and pass through the bottom plate 310 and the side walls 331 laterally.

Figure 10:
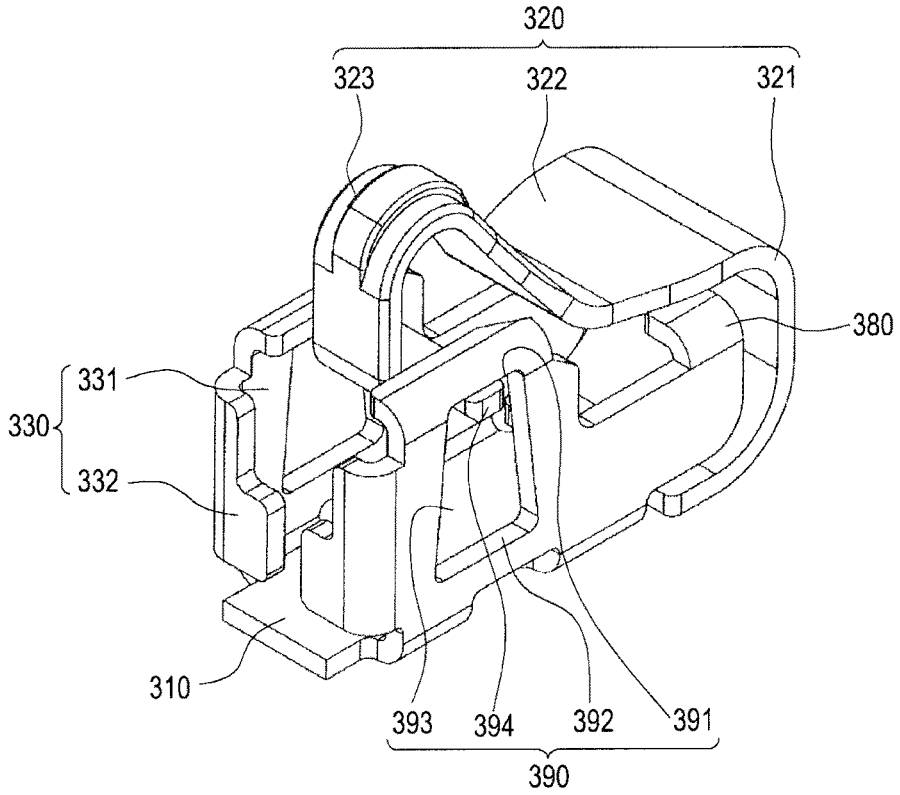
FIG. 10 is a perspective view illustrating another embodiment of a pressing preventing part and a rising preventing part of the configuration of a connecting terminal device according to another embodiment of the present disclosure.

FIG. 10 is a perspective view illustrating pressing preventing parts 380 and rising preventing parts 390 of the configurations of the connecting terminal device 300 according to another embodiment of the present disclosure.

Referring to FIG. 10, the pressing preventing parts 380 are bent horizontally from upper end surfaces of the side walls 331, and may include upper supports to make contact with the lower surface of the movable part 320 as the movable part 320 is pressed.

For example, a pair of pressing preventing parts 380 are provided to be bent horizontally from the upper end surfaces of the side walls 331 and to face each other symmetrically. The absorption surface 322 of the movable part 320 is positioned on the pair of pressing preventing parts 333, and a pair of pressing preventing parts 333 are disposed below the absorption surface 322 to be symmetrical to each other leftwards and rightwards.

Accordingly, by allowing the pressing preventing parts 333 extending from the side walls 331 to support the lower side of the absorption surface 322 when the movable part 322 is pressed, the resilient force of the resilient part 321 can be prevented from being lowered as an influence of the pressing operation on the absorption surface 322 is reduced even though a force is applied to the movable part 322 consistently and repeatedly.

The rising preventing part 390 includes a cutaway portion 393, first and second stop portions 391 and 392, and a latch 394.

The cutaway portions 393 may be formed on the side walls 331 to form the stop portions 394.

The first stop portion 391 may be formed at an upper end of the cutaway portion 393 to be stopped by, or released from, the latch 394, which will be described below, when the connecting part 323 is raised.

The second stop portion 391 is formed at a lower end of the cutaway portion 393 to be stopped by, or released from, the latch 394, which will be described below, when the connecting part 323 is pressed.

The latch 394 extends to the outer widthwise side of the connecting part 323, and is formed at one end of the connecting part 323 to be stopped by, or released from, the first and second stop portions 391 and 392 when the connecting part 323 is pressed or raised.

The cutaway portion 393 has a through-hole such that the latch 394 passes through the through-hole to be coupled to the through-hole. The latch 394 may be raised and lowered in the through-hole.

For example, if the connecting part 323 is pressed by an external force, the connecting part 323 is lowered in the through-hole and the latch 394 of the connecting part 323 is lowered together. Then, the latch 394 is stopped by the second stop portion 392 formed at a lower end of the through-hole and is not lowered further.

For example, if the connecting part 323 is raised by an external force, the connecting part 323 is raised in the through-hole and the latch 394 of the connecting part 323 is raised together. Then, the latch 394 is stopped by the first stop portion 391 formed at an upper end of the through-hole and is not raised further.

In this way, because the latch 394 is stopped by the first and second stop portions 391 and 392 to prevent excessive pressing or rising of the connecting part 323, the connecting part 323 can be prevented from being deformed, deformation of the movable part 320 can be prevented, and the resilient force of the resilient part 321 can be prevented from being lowered or lost.

Next, an operation of the connecting terminal device 300 without a stopper according to various embodiments ('a second embodiment') of the present disclosure will be described.

Figure 9A:
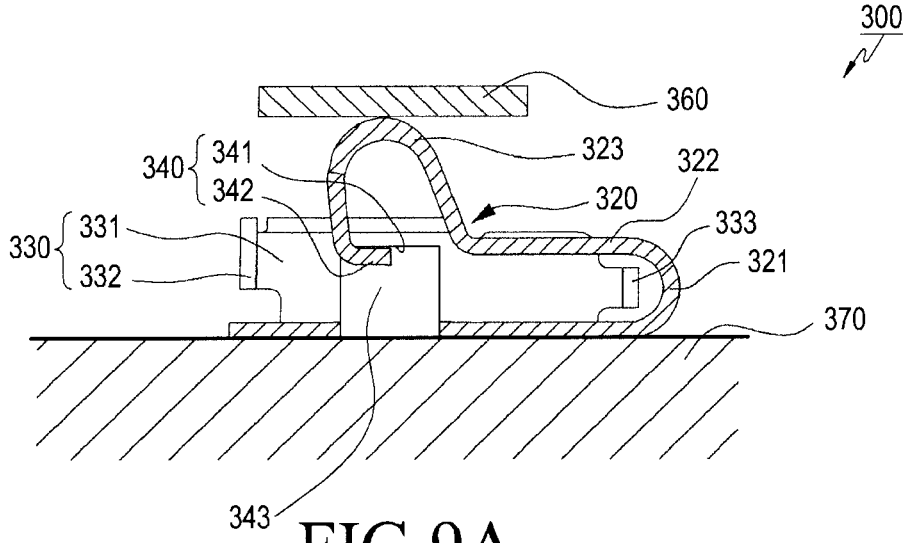
FIG. 9A.
Figure 9B:
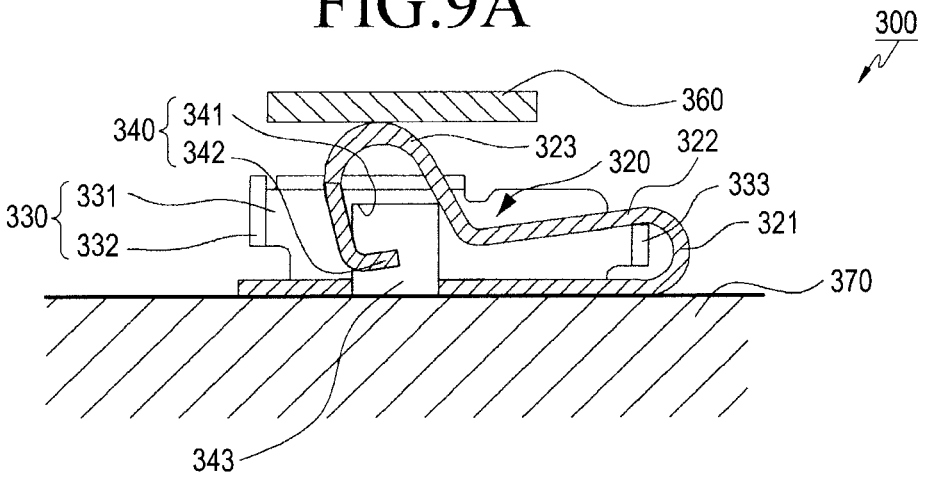
FIG. 9B, and FIG. 9C are side sectional views illustrating an operational state of a connecting terminal device according to various embodiments of the present disclosure.
Figure 9C:
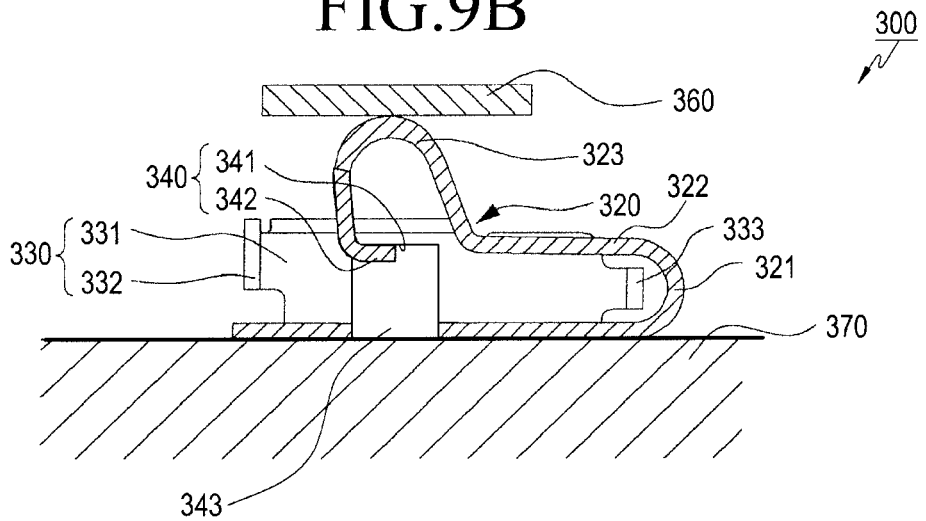

FIG. 9A illustrates an initial connection time point of the connecting terminal device 300, FIG. 9B illustrates a connection state of the connecting terminal device 300, and FIG. 9C illustrates a state in which the connecting terminal device 300 is prevented from being excessively raised.

Referring back to FIGS. 7 and 8, the connecting terminal device according to various embodiments ('the second embodiment') of the present disclosure further includes a bottom plate 310 fixed to the substrate 370 (see FIG. 9), and protective walls 330 including side walls and a front wall 332 that interrupt external forces applied from the front surface and side surfaces of the connecting terminal device 300 while the movable part 320 that is moved upwards and downwards as it is connected to the external object 360 (see FIG. 9) to form a basic structure of the connecting terminal device 200 in a C-clip form as a whole.

The pressing preventing parts 333 that support the lower side of the movable part 320 to prevent the resilient force of the resilient part from being lowered or lost according to a consistent and repeated pressing operation are provided on the side walls. Further, the rising preventing parts 340 that restrict the movable part 320 from being excessively raised upwards are provided on the connecting part and the side walls.

The rising preventing parts 340 according to various embodiments ('the second embodiment') of the present disclosure are the same as the rising preventing parts 340 according to the first embodiment of the present disclosure except for the structure of the latches 342 provided at ends of the connecting part.

In the various embodiments ('the second embodiment') of the present disclosure, the movable part 320 is prevented from being raised upwards while the latches 342 are stopped by the bottom surfaces of the stop portions 341 that forms the upper surfaces of the cutaway portions 343 formed by cutting the side walls, and the cutaway portions 343 are cut away to be continuously connected to the side walls and the entire bottom plate 310 such that the side walls and the bottom plate 310 are divided with respect to the cutaway portions 343 forwards and downwards.

Here, in the various embodiments ('the second embodiment') of the present disclosure, the stopper 250 (see FIG. 4) bent from the bottom plate 310 upwards to have an 'n' shape is not formed, and accordingly, a stopper recess for eliminating an interference with the stopper 250 (see FIG. 4) is not formed at an end of the connecting part.

Accordingly, the latches 342 formed at the ends of the connecting part has a form that further extends to the outside while having the entire width of an end of the connecting part, which is a substantially 'T' shape when viewed from the top of the connecting part.

Hereinafter, in an operation of connecting an external object 360 (see FIG. 9) to the connecting terminal device 300 according to various embodiments ('the second embodiment') of the present disclosure, for example, the operation of preventing the movable part 320 from being excessively pressed downwards to prevent a deformation of the resilient part through the pressing preventing part 333 and the operation of preventing the movable part 320 from being excessively raised upwards through the rising preventing part 340 are the same except for an operation of stopping the movable part by the stopper 250 (see FIG. 4) as compared with the above-mentioned first embodiment, a detailed description thereof will be omitted.

According to various embodiments of the present disclosure, as illustrated in FIG. 7, a connecting terminal device may include: a bottom plate; one or more protective walls provided on side surfaces of the bottom plate to protect the movable part; pressing preventing parts provided at ends of the protective walls and provided between the bottom plate and the movable part to make contact with the movable part as the movable part is pressed so as to be connected to the rear surface of the bottom plate in a curved fashion, so that the pressing preventing parts are pressed or raised by a resilient force such that the pressing movement of the movable part electrically connected to the external object is restricted; and rising preventing parts provided on side surfaces of the protective walls to prevent rising movement of the movable part so as to prevent the movable part from being separated from the protective walls.

According to various embodiments of the present disclosure, the protective walls may include: side walls that are formed on opposite surfaces of the bottom plate and that may be vertically and horizontally bent to protect side surfaces of the movable part; and a front wall formed on the front surface of the bottom plate to be vertically bent to protect the front surface of the movable part.

According to various embodiments of the present disclosure, the pressing preventing parts may include side supports formed on side surfaces of ends of the side walls to be vertically bent to make contact with the movable part as the movable part is pressed.

According to various embodiments of the present disclosure, the rising preventing parts may include: cutaway portions formed in the bottom plate and the side walls; stop portions formed at upper ends of the cutaway portions; and latches formed at ends of the connecting part and extending to the outer widthwise side of the connecting party to be stopped by, or released from, the stop portions.

According to various embodiments of the present disclosure, the cutaway portions may include divided recesses that divide the bottom plate and the side walls forwards and rearwards.

According to various embodiments of the present disclosure, the pressing preventing parts may include upper supports formed at upper ends of the side walls to be horizontally bent so as to make contact with a lower surface of the movable part as the movable part is pressed.

According to various embodiments of the present disclosure, the rising preventing parts may include: cutaway portions formed on the side walls to pass through the side walls; first stop portions formed at upper ends of the cutaway portions; second stop portions formed at lower ends of the cutaway portions; and latches formed at ends of the connecting part and extending to the outer widthwise side of the connecting party to be stopped by, or released from, the first and second stop portions when the connecting part is pressed or raised.

According to various embodiments of the present disclosure, the cutaway portions may be connected to through-holes through which the latches pass to be coupled thereto.

According to various embodiments of the present disclosure, a connecting terminal device provided in an electronic device may include: a substrate provided in the electronic device; a bottom plate fixed to the substrate; a movable part connected to a rear surface of the bottom plate in a curved fashion and pressed or raised by a resilient force to be electrically connected to an external object; one or more protective walls provided on side surfaces of the bottom plate to protect the movable part; pressing preventing parts provided at ends of the protective walls and provided between the bottom plate and the movable plate to make contact with the movable plate as the movable plate is pressed, restricting pressing movement of the movable part; rising preventing parts provided on side surfaces of the protective walls to prevent a rising movement of the movable part so as to prevent the movable part from being separated from the protective walls; and a stopper provided on the bottom plate to restrict a movement of the movable part in a pressing direction.

Figure 11:
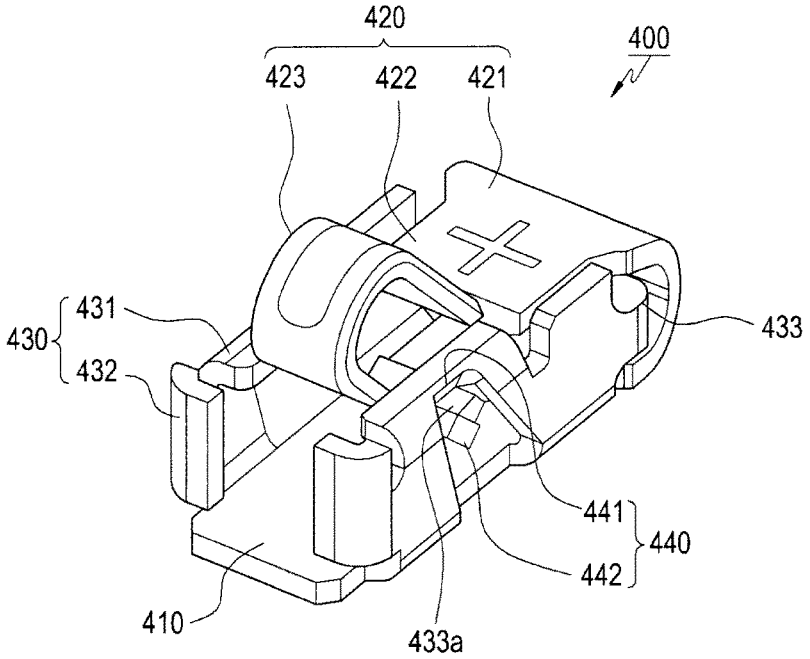
FIG. 11 is a perspective view illustrating a configuration of a connecting terminal device according to another embodiment of the present disclosure.

FIG. 11 is a perspective view illustrating a configuration of a connecting terminal device 400 additionally including a second pressing part 433*a* without a stopper 250 (see FIG. 4) according to another embodiment ('a third embodiment') of the present disclosure.

Referring to FIG. 11, the connecting terminal device 400 provided in the electronic device includes a bottom plate 410, a movable part 420, one or more protective walls 430, first and second pressing preventing parts 433 and 433*a*, and a rising preventing part 440.

As shown in FIG. 1, the bottom plate 410 is adapted to be fixed to a substrate 470 (see FIG. 13) provided in the electronic device 10.

Figure 13:
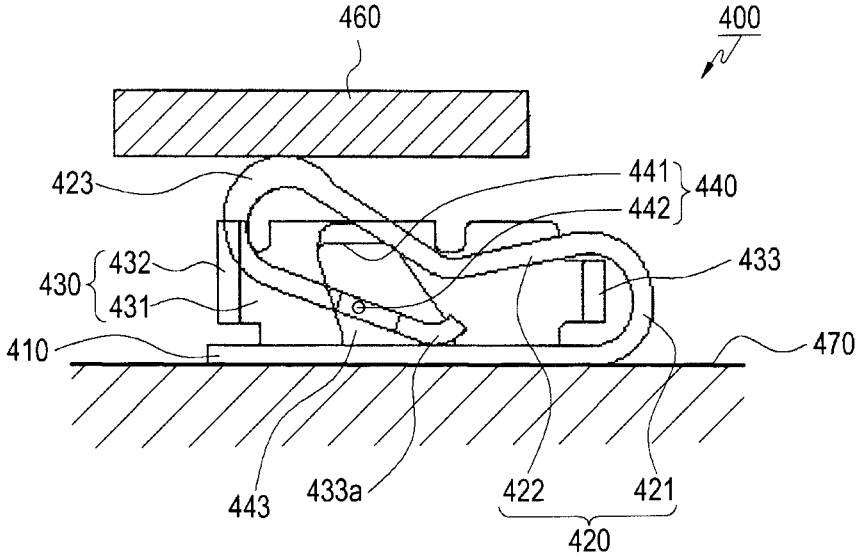
FIG. 13 is a side sectional view illustrating a state after an operation of a connecting terminal device according to another embodiment of the present disclosure.

As shown in FIG. 13, the movable part 420 is connected to the rear surface of the bottom plate 410 in a curved way to be pressed by a resilient force or raised so as to be electrically connected to an external object 460.

The protective walls 430 is provided along the side surfaces of the bottom plate 410 to protect the movable part 420.

The pressing preventing parts 433 are provided between the bottom plate 410 and the movable part 420, and may be provided on ends of the protective walls 430 to restrict pressing movement of the movable part 420 while making contact with the movable part 420 as the movable part 420 is pressed.

The second pressing preventing parts 433*a* are provided at one end of the movable part 420 such that one end of the movable part 420 makes contact with the bottom plate 410 to restrict a pressing movement of the movable part 420 as the movable part 420 is pressed.

The rising preventing parts 440 are provided on side surfaces of the protective walls 430 to restrict rising movement of the movable part 420, thereby preventing a separation of the movable part 420 from the protective walls 430.

In this way, additionally, a resilient force may be prevented from being lowered or lost even though the movable part 420 is repeatedly pressed and raised, and accordingly, a deformation error and a connection error of the product may be further prevented by forming the first and second pressing preventing parts that restrict a pressing of the movable part 420 on the protective wall 430 without a stopper 250 (see FIG. 4), and forming the rising preventing parts 440 that restricts a rising of the movable part 420 on the protective wall 430.

Further, because the movable part 420 includes a resilient part 421, a connecting part 423, and an absorption surface 422 and the configurations of the movable part 420 have been described in the various embodiments ('the first embodiment') of the present disclosure, a detailed description thereof will be omitted.

The first pressing preventing part 433 may be situated on the inside of the resilient part 421. For example, the first pressing preventing part 433 is situated on the inside of the resilient part 421 and is provided below the absorbing surface 422.

The second pressing preventing part 433*a* is situated at one end of the connecting part 423 of the movable part 420 and is also situated on the bottom plate 410.

The protective wall 430 may include side walls 431 and a front wall 432.

The side walls 431 are formed on opposite surfaces of the bottom plate 410 to be bent vertically and horizontally to protect the side surfaces of the movable part 420.

The front wall 432 is formed on a front surface of the bottom plate 410 to be bent at the right angle so as to protect the front surface of the movable part 420.

An insertion hole 432*a* is formed on the front wall 432 such that the connecting part 423 is inserted into, and separated from, the insertion hole 432*a* as the movable part 420 is pressed or raised.

For example, when the connecting part 423 is pressed by the external object to be lowered, it is inserted into the insertion hole 432*a*, and when the connecting part 423 is raised by an external force again, it is separated from the insertion hole 432*a*.

The first pressing preventing parts 433 are bent vertically on side surfaces of ends of the side walls 431, and include side supports to make contact with the movable part 420 as the movable part 420 is pressed.

For example, the side walls 431 are formed on the opposite side surfaces of the bottom plate, and ends of the side walls 431 are vertically bent to face each other so as to form the first pressing preventing parts 433.

The second pressing preventing parts 433*a* may include a curved support such that the connecting part 423 is slid when being connected to the upper surface of the bottom plate 410 as the movable part 420 is pressed.

For example, if the movable part 420 is pressed, the connecting part 423 of the movable part 420 is also pressed, and when one end of the connecting part 423 makes contact with the upper surface of the bottom plate 410, the second pressing preventing parts 433*a* are slid by the curve. According to an embodiment of the present disclosure, the second pressing preventing parts 433*a* include curved supports, and the curved portions of the curved supports make contact with the upper surface of the bottom plate 410.

The rising preventing parts 440 include a cutaway portion 443, a stop portion 441, and a latch 442, and the configurations of the rising preventing part has been described in the various embodiments ('the first embodiment') of the present disclosure, and thus will be omitted.

In this state, an operational process of the connecting terminal device 400 provided in the electronic device 10 will be described in more detail as follows.

Referring back to FIG. 11, the connecting terminal device 400, according to the present disclosure, further includes a bottom plate 410 fixed to the substrate, and protective walls 430 that interrupt external forces applied from the front surface and side surfaces of the connecting terminal device 400 while the movable part 420 that is moved upwards and downwards as it is connected to the external object to form a basic structure of the connecting terminal device 400 in a C-clip form as a whole. In particular, the protective wall 430 is provided with a rising preventing part 440 that restricts the first and second pressing preventing part 433 and 433*a* that restricts the movable part 420 from being excessively pressed downwards and the movable part 420 from being excessively raised upwards.

The pressing preventing part, according to various embodiments ('the third embodiment') of the present disclosure, is the same as the pressing preventing part 233 (see FIG. 3) according to the first embodiment of the present disclosure except for the structure of the second pressing preventing part 433*a* provided at an end of the connecting part 423.

The rising preventing part 440, according to various embodiments ('the third embodiment') of the present disclosure, prevents the movable part 420 from being raised upwards while the latch 442 is stopped by the bottom surface of the stop portion 441 forming the upper surface of the cutaway portion 443 formed by cutting the side wall 431.

For example, in the various embodiments ('the third embodiment') of the present disclosure, the stopper 250 (see FIG. 4) bent from the bottom plate 410 upwards to have 'n' shape is not formed, and accordingly, a stopper recess for eliminating an interference with the stopper is not formed at an end of the connecting part 423.

According to an embodiment of the present disclosure, the bottom plate 410 has not stopper 250 (see FIG. 4), and includes a planar plate for a slide movement of the second pressing preventing part 433*a*.

Accordingly, by allowing the first pressing preventing parts 433 extending from the side walls 431 to support the upper side of the resilient part 421 when the movable part 420 is pressed, the resilient force of the resilient part 421 can be prevented from being lowered as an influence of the pressing operation on the resilient part 421 is reduced even though a force may be consistently and repeatedly applied to the movable part 420.

A pair of first pressing preventing parts 433 are disposed on the left and right sides inside the resilient part 421 in a form in which they are vertically bent on the rear sides of the side walls 431 that are disposed on the opposite side surfaces of the bottom plate 410 to face each other symmetrically. Accordingly, the resilient part 421 may be supported by a pair of left and right first pressing preventing parts 433 while being balanced leftwards and rightwards.

Then, the first pressing preventing parts 433 can be prevented from being pressed, and the second pressing preventing parts 433*a* may also be prevented from being excessively pressed.

Meanwhile, as described above, the present disclosure includes rising preventing parts 440 that may prevent the movable part 420 from being excessively raised on side surfaces of the protective walls 430.

For example, the rising preventing parts 440 are pressed downwards from the upper side of the connecting part 423 when the external object makes contact with the connecting part 423, in which case the connecting part 423 is raised upwards by the resilient force of the resilient part 421 when the external object deviates from the connecting part 421 and the connecting part 423 is stopped by the protective walls 430 so that the movable part 420 can be prevented from deviating from the protective walls 430 by preventing the movable part 420 from being excessively raised upwards.

Hereinafter, an operation of connecting the above-configured connecting terminal device 400, according to various embodiments ('the third embodiment) of the present disclosure, to an external object will be described.

Figure 12:
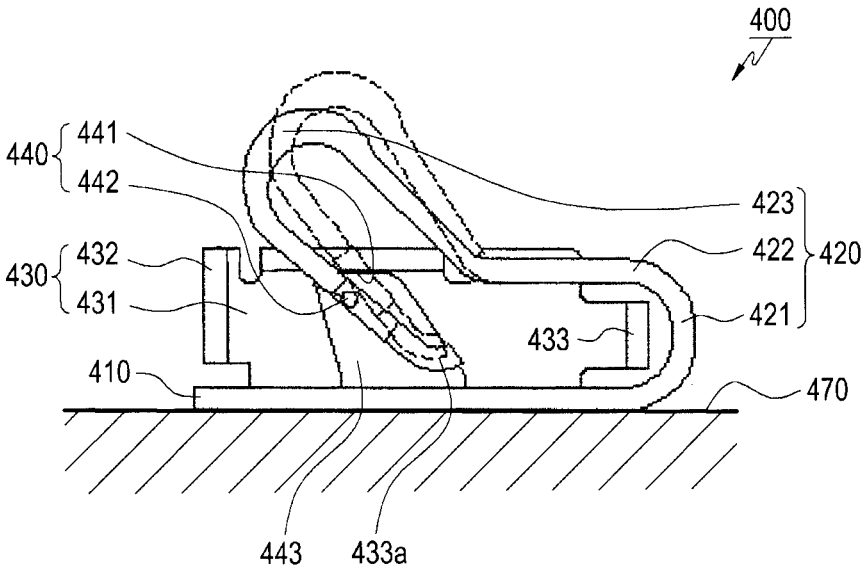
FIG. 12 is a side sectional view illustrating a state before an operation of a connecting terminal device according to another embodiment of the present disclosure.

FIG. 12 illustrates an initial connection time point of the connecting terminal device 400, and FIG. 13 illustrates a state in which the connecting terminal device 400 is connected and a state in which the connecting terminal is prevented from being excessively pressed.

In the initial time point of FIG. 12, the connecting terminal device 400 is soldered and fixed to the substrate through the bottom plate 410 through the bottom plate 410 while the entire connecting terminal device 400 is exposed to the outside, and is initially connected to an external object such as an NFC antenna that is embedded on the rear cover of a smartphone. At a time point (connection time point) when the connecting terminal device 400 is connected, the movable part 420 of the connecting terminal device 400 mounted on the substrate is moved downwards by a predetermined height while connecting the connecting part 423 and the external object. Then, the resilient part 421 may be resiliently deformed while absorbing an external force transferred to the connecting part 423, and may be supported by the upper ends of the first pressing preventing parts 431 bent at the rear ends of the side walls 433 at a time point when the movement of the movable part 420 is completed.

Accordingly, by allowing the first pressing preventing parts 433 to support the upper side of the resilient part 423 when the movable part 420 is pressed due to the connection of the external object and the connecting part 421, the resilient force of the resilient part 421 can be prevented from being lowered as an influence of the pressing operation on the resilient part 421 is reduced even though a force is applied to the movable part 420 consistently and repeatedly.

Further, in the connection state of FIG. 13, because the movable part 420 is lowered while being supported by the first pressing preventing part 433 even when the movable part 420 is further lowered as an abnormal external force is applied to the movable part 420, for example, an abnormal external force, such as an impact caused by a smartphone that drops to the ground surface, is applied, an influence of the abnormal external force applied to the movable part 420 on the resilient part 421 can be reduced, and accordingly, an excessive deformation of the resilient part 421 can be prevented. In addition, the movable part 420 situated on the front side of the first pressing preventing parts 433 is further moved downwards while taking the first pressing preventing parts 433 as support points so that the second pressing preventing parts 433*a* provided at one end of the connecting part 423 make contact with the upper surface of the bottom plate 410 and are slid at the same time to restrict a further downward movement of the connecting part. Accordingly, an additional deformation of the movable part may be prevented.

Meanwhile, as illustrated in FIG. 12, when an external force is applied the connecting part 421 from the lower side to the upper side by the resilient part 423, because the rising preventing parts 440 that restrict a rising movement of the movable part 420 are provided on the side surfaces of the protective walls 430 and each of the rising preventing parts 440 includes the cutaway portion 443, the stop portion 441, and the latch 442, the movable part 420 rises by a predetermined height and the latches provided at ends of the connecting part 423 are stopped by the lower sides of the stop portions 441 that defines the upper surfaces of the cutaway portions 443 on the side walls 431 so that a further rising movement of the movable part 420 can be suppressed and the movable part 420 can be prevented or inhibited from being excessively raised.

In this way, because the present disclosure includes the pressing preventing parts 433 and 433*a* that prevent excessive rising of the movable part 420 and the rising preventing parts 440 that prevent excessive rising of the movable part 420 on the protective walls 430 that protect the front surface and the side surfaces of the movable part 420, the connection terminal device 400 can be prevented or inhibited from being deformed by an external force applied to all sides of the connection terminal device 400, and further the resilient force of the resilient part 421 can be prevented or inhibited from being lowered or lost, so that a deformation inferiority of the product can be prevented or resisted.

According to various embodiments of the present disclosure, as illustrated in FIG. 11, a connecting terminal device may include: a bottom plate; a movable part connected to a rear surface of the bottom plate in a curved fashion and pressed or raised by a resilient force to be electrically connected to an external object; one or more protective walls provided on side surfaces of the bottom plate to protect the movable part; first pressing preventing parts provided at ends of the protective walls and provided between the bottom plate and the movable plate to make contact with the movable plate as the movable plate is pressed, thereby restricting a pressing movement of the movable part; a second pressing preventing part provided at one end of the movable part such that one end of the movable part makes contact with the bottom plate as the movable part is pressed, thereby restricting a pressing movement of the movable part; and rising preventing parts provided on side surfaces of the protective walls to restrict rising movement of the movable part so as to prevent or inhibit the movable part from being separated from the protective walls.

According to various embodiments of the present disclosure, the movable part may include: a resilient part connected to the rear surface of the bottom plate to be roundly curved upwards to provide a resilient force such that the movable part is pressed or raised; a connecting part extending from the resilient part upwards by a predetermined height to be electrically connected to the external object; and an absorbing surface provided between the resilient part and the connecting part and extending such that the resilient part and the connecting part are integrally connected to each other.

According to various embodiments of the present disclosure, the protective walls may include: side walls formed on opposite surfaces of the bottom plate to be vertically and horizontally bent to protect side surfaces of the movable part; and a front wall formed on the front surface of the bottom plate to be vertically bent to protect the front surface of the movable part.

According to various embodiments of the present disclosure, an insertion hole into and from which the connection part is inserted and separated as the movable part is pressed and raised may be further formed in the front wall.

According to various embodiments of the present disclosure, the first pressing preventing parts may include side supports formed on side surfaces of ends of the side walls to be vertically bent to make contact with the movable part as the movable part is pressed.

According to various embodiments of the present disclosure, the second pressing part may include a curved support such that the contact part is slid when making contact with the bottom plate as the movable part is pressed.

According to various embodiments of the present disclosure, a connecting terminal device provided in an electronic device, the connecting terminal device may include: a substrate provided in the electronic device; a bottom plate fixed to the substrate; a movable part connected to a rear surface of the bottom plate in a curved fashion and pressed or raised by a resilient force to be electrically connected to an external object; one or more protective walls provided on side surfaces of the bottom plate to protect the movable part; first pressing preventing parts provided at ends of the protective walls and provided between the bottom plate and the movable plate to make contact with the movable plate as the movable plate is pressed, thereby restricting a pressing movement of the movable part; a second pressing preventing part provided at one end of the movable part such that one end of the movable part makes contact with the bottom plate as the movable part is pressed, thereby restricting a pressing movement of the movable part; and rising preventing parts provided on side surfaces of the protective walls to restrict a rising movement of the movable part so as to prevent or inhibit the movable part from being separated from the protective walls.

Figure 14:
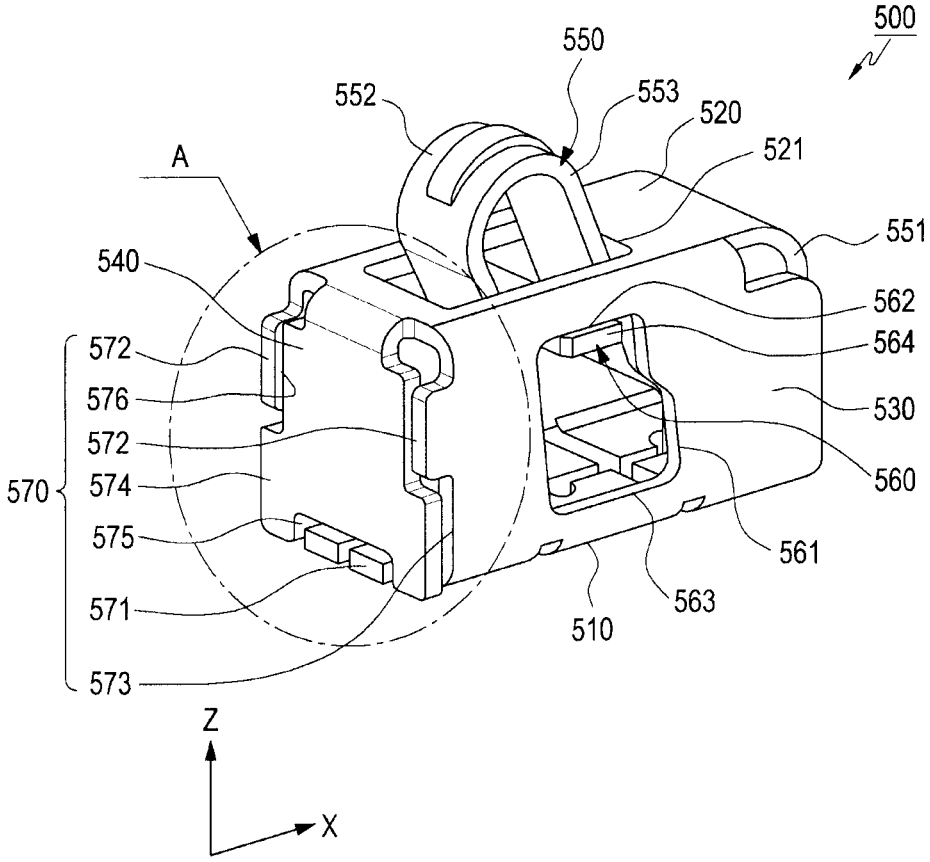
FIG. 14 is a perspective view illustrating a configuration of a connecting terminal device according to another embodiment of the present disclosure.
Figure 15:
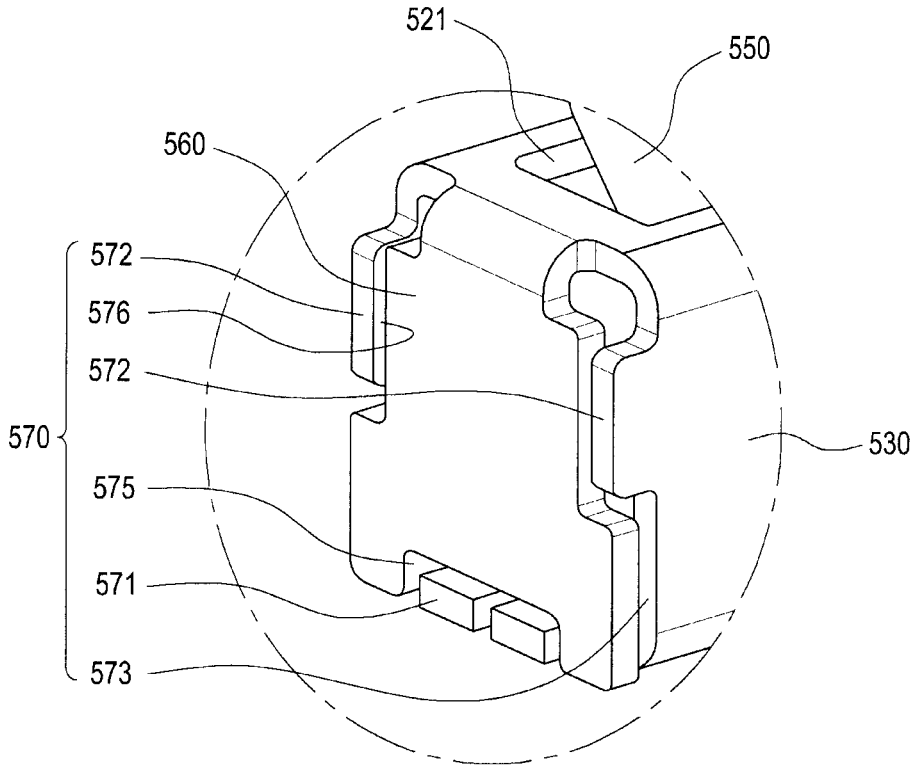
FIG. 15 is an enlarged perspective view of portion A of FIG. 14.

FIG. 14 is a perspective view illustrating a configuration of a connecting terminal device 500 according to another embodiment ('a fourth embodiment') of the present disclosure. FIG. 15 is an enlarged perspective view of portion A of FIG. 14.

Referring to FIGS. 14 and 15, the connecting terminal device 500 provided in the electronic device may include a bottom plate 510, a fixed plate 520, side plates 530, a front plate 540, a movable part 550, and a rising preventing part 560.

The bottom plate 510 is adapted to be fixed to a substrate 590 (see FIG. 16) provided in the electronic device 10 (see FIG. 1).

The fixed plate 520 may be provided on the bottom plate 510 to be integrally connected to upper ends of the side plates 530 and to support the fixed plate 520 at the same time.

The side plates 530 may be provided on the bottom plate 510 and opposite surfaces of the fixed plate 520 to integrally connect and support the bottom plate 510 and the fixed plate 520 at the same time.

The front plate 540 may be provided on the front sides of the bottom plate 510, the fixed plate 520, and the side plates 530 to be integrally connected to one end of the fixed plate 520 and to be curved so as to couple one end of the bottom plate 510 and ends of the side plates 530.

Figure 16:
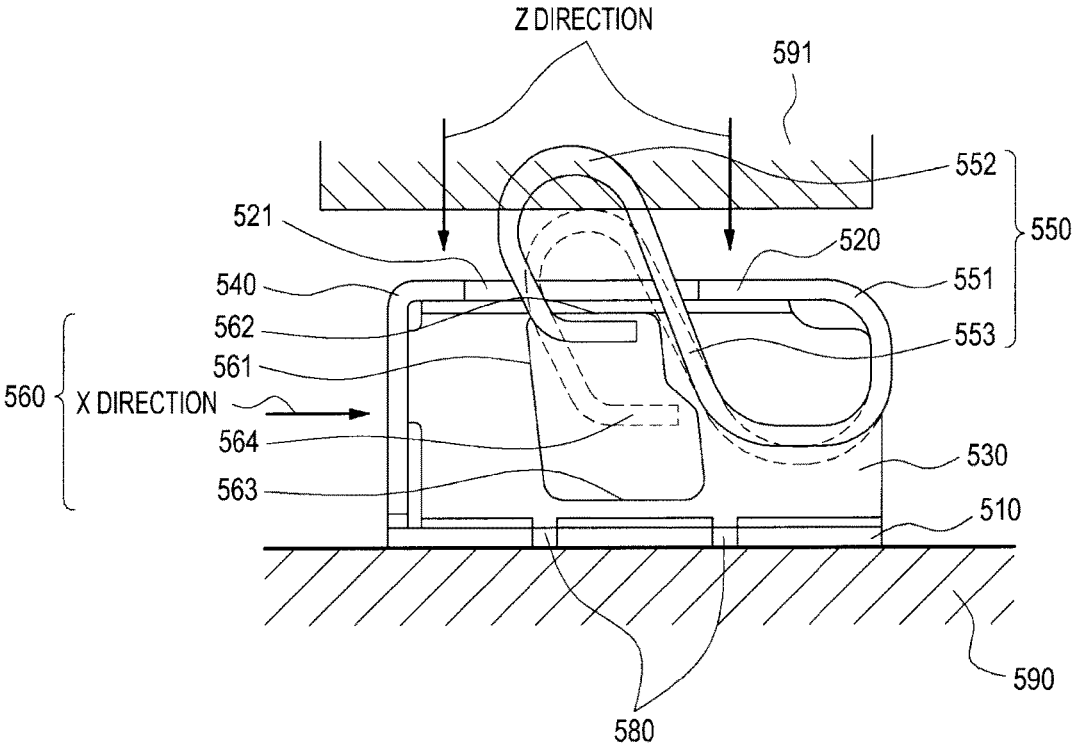
FIG. 16 is a side sectional view illustrating an operational state of a connecting terminal device according to another embodiment of the present disclosure.

The movable part 550 is connected to the rear surface of the fixed plate 520 in a curved way to be pressed by a resilient force or raised so as to be electrically connected to an external object 591 (see FIG. 16). For example, the movable part 550 may be connected to be curved towards the lower side of the rear surface of the fixed plate 520 and pass through a protruding through-hole 521 of the fixed plate 520 to protrude to the outside.

The rising preventing parts 560 may be provided the side plates 530 to restrict rising movement of the movable part 550, thereby preventing a separation of the movable part 550 from the fixed plate 520.

In this way, the bottom plate 510, the fixed plate 520, the side plates 530, and the front plate 540 may be coupled to each other through a convexo-concave structure 570 that may prevent or resist a deformation of the connecting terminal device 500 to protect the connecting terminal device 500 from an external force applied to the front surface of the connecting terminal device 500, to prevent deformation of the connecting terminal device 500 when an external impact (for example, in the Z axis direction) (see FIG. 16) is applied from the upper side of the fixed plate 520, and protect the movable part 550 from external forces of various directions applied to the connecting terminal device 500 by protecting the lateral sides. Furthermore, a resilient force can be prevented or inhibited from being lowered or lost even though a pressing operation and a rising operation of the movable part 550 is repeatedly and consistently performed, by restricting an abnormal movement of the movable part 550, and accordingly, a deformation inferiority and a connection inferiority can be prevented or inhibited.

Further, the convexo-concave structure 570 will be described in more detail. First, referring back to FIGS. 14 and 15, the convexo-concave structure 570 may include a bottom boss 571, side bosses 572, side recesses 573, a plurality of first coupling bosses 574, and a plurality of first and second coupling recesses 575 and 576.

The bottom boss 571 may be formed at one end of the bottom plate 510 to be coupled to the plurality of first coupling recesses 575 of the front plate 540, which will be described below.

The side bosses 572 and the side recesses 573 may be formed at ends of the side plates 530 to be coupled to the plurality of first coupling bosses 574 and the plurality of second coupling recesses 576, which will be described below.

The plurality of first coupling recesses 575 may be formed at a lower end of the front plate 540 to be coupled to the bottom boss 571.

The plurality of first coupling bosses 574 and the plurality of second coupling recesses 576 may be formed on the opposite side surfaces of the front plate 540 to be coupled to the side bosses 572 and the side recesses 573.

According to an embodiment of the present disclosure, when the bottom plate 510, the fixed plate 520, the side plates 530, and the front plate 540 are coupled to each other by the convexo-concave structure 570, the plurality of first coupling recesses 575 formed at a lower end of the front plate 540 may be coupled to the bottom boss 571 of the bottom plate 510, the first coupling bosses 574 formed on the opposite side surfaces of the front plate 540 may be coupled to the side bosses 572 of the side plates 530, and the second coupling recesses 576 formed on the opposite side surfaces of the front plate 540 may be coupled to the side recesses 573 of the side plate 530.

A plurality of soldering holes 580 may be formed in the bottom plate 510 such that lead may be inserted into the soldering holes 580 when the connecting terminal device 500 is soldered to the substrate 590. The soldering holes 580 may be circular holes. For example, the soldering holes 580 may have various different shapes other than the circular shape for the insertion of lead. For example, the soldering holes 580 may have, for example, any one of a tetragonal shape, a diamond shape, or an elliptical shape.

Figure 17:
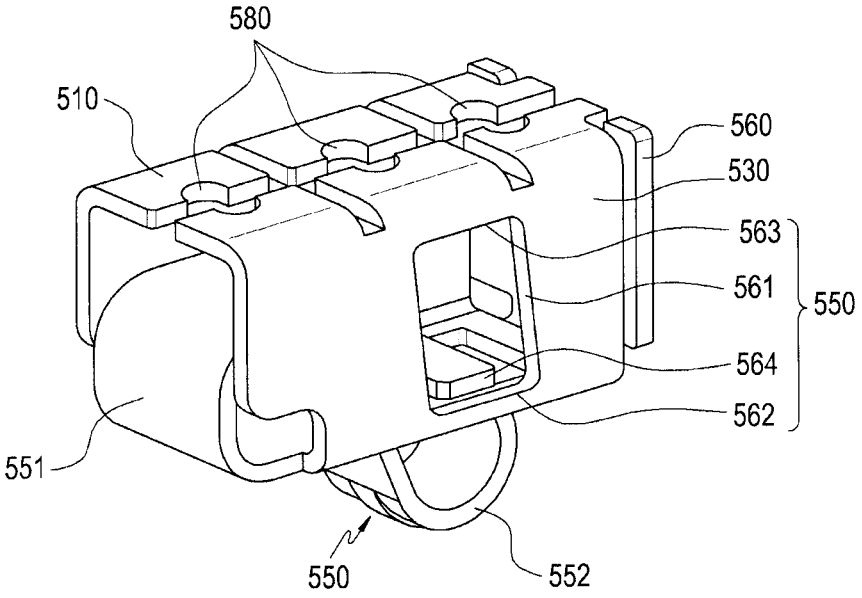
FIG. 17 is a perspective view illustrating a bottom plate of a configuration of a connecting terminal device according to another embodiment of the present disclosure.
Figure 18:
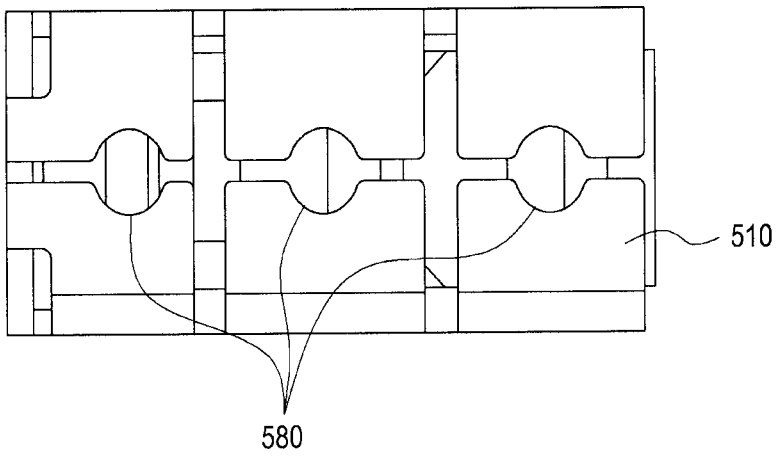
FIG. 18 is a perspective view illustrating a soldering hole of a configuration of a connecting terminal device according to another embodiment of the present disclosure.

According to an embodiment of the present disclosure, as illustrated in FIGS. 17 and 18, the connecting terminal device 500 is mounted on the upper surface of the substrate 590, and the substrate 590 and the bottom plate 510 of the connecting terminal device 500 may be soldered to fix the connecting terminal device 500. Then, lead may be inserted into the plurality of soldering holes 580 of the bottom plate 510 and may be collected to solder the substrate 590 and the bottom plate 510, thereby improving the soldering efficiency.

Accordingly, because lead, for example, may be inserted into the plurality of soldering holes 580 of the bottom plate 510 to be soldered to the substrate 590, the soldering efficiency between the connecting terminal device 500 and the substrate 590 can be improved, and the substrate 590 and the bottom plate 510 can be prevented or resisted from being separated from each other or deformed by an external force transferred to the upper side (for example, in the Z axis direction) (see FIG. 16) of the connecting terminal device 500.

Further, the configuration of the fixed plate 520 will be described in more detail. Referring back to FIG. 16, the front surface of the fixed plate 520 may be curved to be integrally connected to the front plate 540, the rear surface of the fixed plate 520 may be curved to be connected to the movable part 550, and a protruding through-hole 521 may be formed on the upper surface of the fixed plate 520 to pass through the movable part 550 and protrude from the fixed plate 520.

For example, an upper end of the front plate 540 may be integrally formed with the front surface of the fixed plate 520 and is curved vertically at the same time, and the first coupling recess 575 formed at a lower end of the front plate 540 may be coupled to the bottom boss 571 formed in the bottom plate 510.

The protruding through-hole 521 may pass through the movable part 550 and protrude to the upper side of the fixed plate 520. For example, the movable part 550 protruding through the protruding through-hole 521 may be electrically connected to the external object 591.

As illustrated in FIG. 16, the movable part 550 may include a resilient part 551, a connecting part 552, and a support 553.

The resilient part 551 may provide a resilient force to press or raise the movable part 550. The resilient part 551 may be connected to the rear surface of the fixed plate 520 to be roundly curved downwards and may be connected to the support 553, which will be described below, at the same time. The support 553 may be provided between the resilient part 551 and the connecting part 552 to integrally connect the resilient part 551 and the connecting part 552, and to extend the resilient part 551 and the connecting part 552.

The connecting part 552 may extend to the resilient part 551 to be electrically connected to the external object 591. For example, the connecting part 552 may pass through the protruding through-hole 521 to protrude to the outside and may be electrically connected to the external object 591 via the support 553 and the resilient part 551.

According to an embodiment of the present disclosure, the resilient part 551 may be arranged below the rear surface of the fixed plate 520, and the connecting part 552 may pass through the protruding through-hole 521 by the support 553 connected to the resilient part 551.

As illustrated in FIG. 14, the rising preventing part 560 may include a cutaway portion 561, first and second stop portions 562 and 563, and a latch 564. For example, the cutaway portion 561 may pass through the latch 564 to be coupled to the latch 564, which will be described below, and may pass through the side plates 530 to be stop or release the latch 564.

The first stop portion 562 may be formed at an upper end of the cutaway portion 561 to make contact with the latch 564 and prevent the latch 564 from being separated from the fixed plate 520.

The second stop portion 563 may be formed at a lower end of the cutaway portion 561 to make contact with the latch 564 and prevent the latch 564 from being excessively pressed.

The latch 564 extends to the outer widthwise side of the connecting part 552, and is formed at one end of the connecting part 552 to be stopped by, or released from, the first and second stop portions 562 and 563 when the connecting part 552 is pressed or raised.

The cutaway portion 561 has a through-hole such that the latch 564 passes through the through-hole to be coupled to the through-hole. For example, the stop through-hole allows the latch 564 to pass through the stop through-hole such that the latch 564 is coupled to the stop through-hole and to move upwards and downwards in the stop through-hole.

In this state, an operational process of the connecting terminal device 500 provided in the electronic device 10 (see FIG. 1) will be described in more detail as follows.

Referring back to FIG. 16, the connecting terminal device 500, according to the present disclosure, mounts the bottom plate 510 on the substrate 590. Then, the substrate 590 and the bottom plate 510 are soldered to each other, and lead is fixedly inserted into the plurality of soldering holes 580 formed in the bottom plate 510 during soldering. The connecting terminal device 500 can improve the soldering efficiency of the substrate 590 by the plurality of soldering holes 580 of the bottom plate 510.

In this state, the external object 591 makes contact with the connecting part 552 of the connecting terminal device 500. For example, the connecting part 552 initially makes contact with the external object 591 such as an NFC antenna installed in the rear cover of a smartphone. At a time point (connection time point) when the connecting terminal device 500 is connected, the movable part 550 of the connecting terminal device 500 mounted on the substrate 590 is moved by a predetermined height while connecting the connecting part 552 and the external object 591. Then, the resilient part 551 is resiliently deformed while absorbing an external force transferred to the connecting part 552 and then the latches 564 of the movable part 550 make contact with the second stop portions 563 of the cutaway portions 561 to restrict a movement of the movable part 550 below the fixed plate at a time point when the movement of the movable part 550 is completed.

Accordingly, by allowing the resilient part 551 to support the movable part 550 when the movable part 550 is pressed due to the connection of the external object 591 and the connecting part 552, the resilient force of the resilient part 551 can be prevented or inhibited from being lowered as an influence of the pressing operation on the resilient part 551 is reduced even though a force is consistently and repeatedly applied to the movable part 550.

Further, in the connection state of FIG. 16, even when an abnormal external force (for example, an abnormal external force such as an impact occurring when a smartphone drops on the ground surface) is applied to the movable part 550, the bottom plate 510, the fixed plate 520, the side plates 530, and the front plates 540 are coupled to each other by a convexo-concave structure 570, so that a deformation of the connecting terminal device 500 and an impact transferred to the movable part 550 can be reduced at the same time. Accordingly, an excessive deformation of the resilient part 551 can be further prevented or resisted.

Meanwhile, as illustrated in FIG. 6C, when an external force is applied the connecting part 552 from the lower side to the upper side by the resilient part 551, because the rising preventing parts 560 that restrict a rising movement of the movable part 550 are provided on the side surfaces of the side plates 530 and each of the rising preventing parts 560 includes the cutaway portion 561, the first and second stop portions 562 and 563, and the latch 564, the movable part 550 rises by a predetermined height and the latches 564 provided at ends of the connecting part 552 are stopped by the lower sides of the stop portions 562 that defines the upper surfaces of the cutaway portions 561 on the side walls 564 so that a further rising movement of the movable part 550 can be suppressed and the movable part 550 can be prevented or inhibited from being excessively raised.

In this way, the bottom plate 510, the fixed plate 520, the side plates 530, and the front plate 540 are coupled to each other by the convexo-concave structure 570 to prevent a deformation of the connecting terminal device 500, so that the product can be protected and a deformation of the product by an external force on the front side (for example, the X axis direction) can be prevented or inhibited, and an excessive movement of the movable part 550 can be prevented or resisted by the fixed plate 520 to prevent or inhibit a deformation of the product. Accordingly, a deformation inferiority of the product can be prevented or resisted.

According to various embodiments of the present disclosure, as illustrated in FIG. 14, the connecting terminal device 500 may include: a bottom plate 510; a fixed plate 520 provided on the bottom plate 510; side plates 530 provided on the bottom plate 510 and opposite side surface of the fixed plate 520; a front plate 540 provided on the front surface of the bottom plate 510, the fixed plate 520, and the side plates 530 to be coupled thereto; a movable part 550 connected to the rear surface of the fixed plate 520 in a curved fashion and protruding to the outside within the fixed plate 520 to be pressed or raised by a resilient force so as to be electrically connected to an external object 591; and rising preventing parts 560 provided in the side plates 530 to restrict a rising movement of the movable part 550 so as to prevent the movable part from being separated from the fixed plate 520, and the bottom plate 510, the fixed plate 520, the side plates 530, and the front plate 540 may be coupled to each other by a convexo-concave structure 570 that is configured to prevent a deformation of the connecting terminal device 500.

According to various embodiments of the present disclosure, the convexo-concave structure may include: a bottom boss formed at one end of the bottom plate; side bosses and side recesses formed at ends of the side plates; and a plurality of first coupling bosses and a plurality of first and second coupling recesses formed on the front surface to be coupled to the bottom boss and coupled to the side bosses and the side recesses.

According to various embodiments of the present disclosure, a plurality of soldering holes into which lead is inserted during soldering may be formed in the bottom plate.

According to various embodiments of the present disclosure, the front surface of the fixed plate may be integrally connected to the front plate in a curved fashion, the rear surface of the fixed plate may be connected to the movable part in a curved fashion, and a protruding through-hole through which the movable part passes to protrude from the fixing plate by a predetermined height may be formed on the upper surface of the fixed plate.

According to various embodiments of the present disclosure, the movable part may include: a resilient part connected to the rear surface of the fixed plate to be roundly curved downwards to provide a resilient force such that the movable part is pressed or raised; a connecting part extending from the resilient part to be electrically connected to the external object; and a support provided between the resilient part and the connecting part and extending such that the resilient part and the connecting part are integrally connected to each other.

According to various embodiments of the present disclosure, the rising preventing parts may include: cutaway portions formed in the side plates to pass through the side plates; first stop portions formed at upper ends of the cutaway portions; second stop portions formed at lower ends of the cutaway portions; and latches formed at ends of the connecting part and extending to the outer widthwise side of the connecting party to be stopped by, or released from, the first and second stop portions when the connecting part is pressed or raised.

According to various embodiments of the present disclosure, the cutaway portions may be connected to catching through-holes through which the latches pass to be coupled thereto.

According to various embodiments of the present disclosure, a connecting terminal device provided in an electronic device may include: a substrate provided in the electronic device; a bottom plate fixed to the substrate; a fixed plate provided on the bottom plate; side plates provided on the bottom plate and opposite side surface of the fixed plate; a front plate provided on the front surface of the bottom plate, the fixed plate, and the side surfaces to be coupled thereto; a movable part connected to the rear surface of the fixed plate in a curved fashion and protruding to the outside within the fixed plate to be pressed or raised by a resilient force so as to be electrically connected to an external object; and rising preventing parts provided in the side plates to restrict a rising movement of the movable part so as to prevent the movable part from being separated from the fixed plate, and the bottom plate, the fixed plate, the side plates, and the front plate may be coupled to each other by a convexo-concave structure that is configured to prevent deformation of the connecting terminal device.

Figure 19:
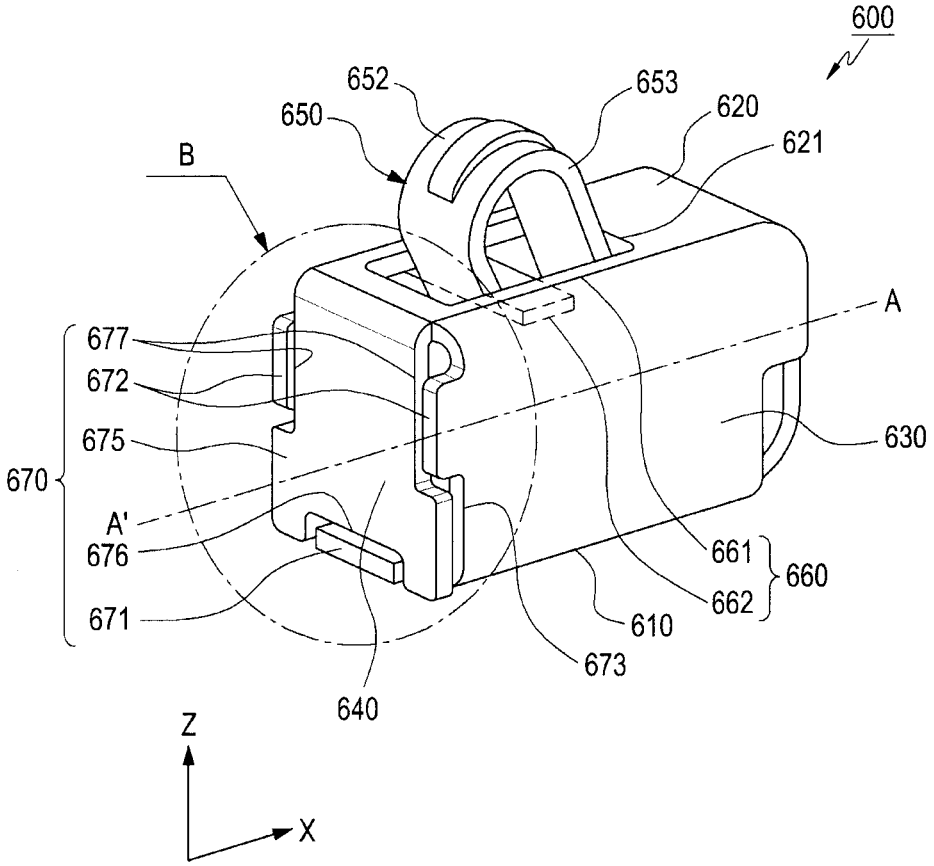
FIG. 19 is a perspective view illustrating a configuration of a connecting terminal device according to another embodiment of the present disclosure.
Figure 20:
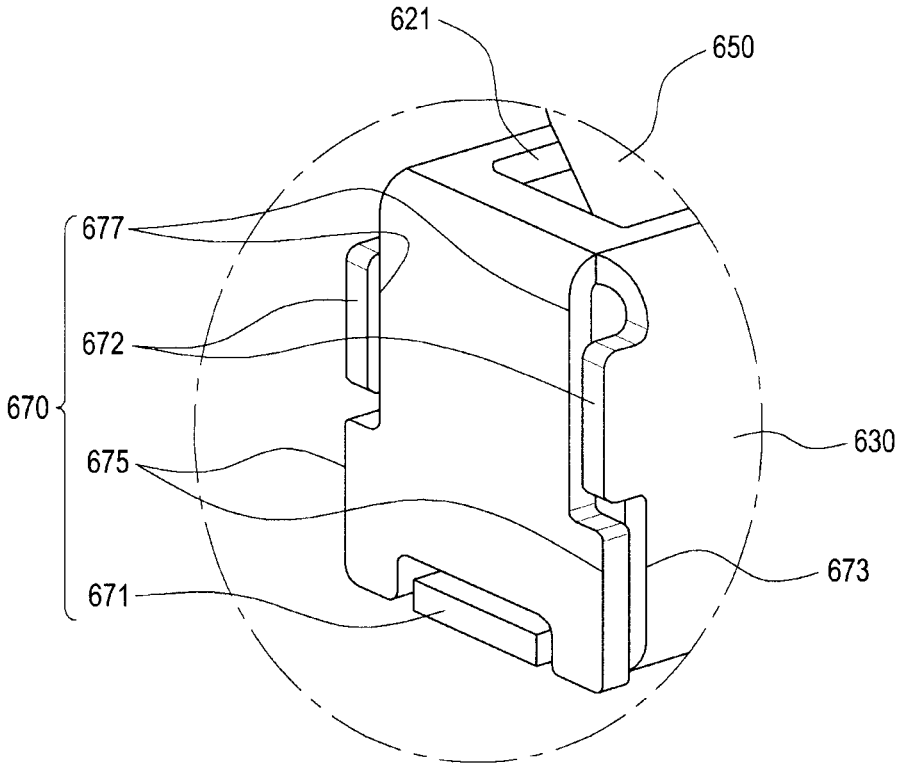
FIG. 20 is an enlarged perspective view of portion B of FIG. 19.

FIG. 19 is a perspective view illustrating a configuration of a connecting terminal device 600 according to another embodiment ('a fifth embodiment') of the present disclosure. FIG. 20 is an enlarged perspective view of portion B of FIG. 19.

Referring to FIGS. 19 and 20, the connecting terminal device 600 provided in the electronic device 10 (see FIG. 1) may include a bottom plate 610, a fixed plate 620, side plates 630, a front plate 640, a movable part 650, and a rising preventing part 660.

The bottom plate 610 is adapted to be fixed to a substrate 680 (see FIG. 23) provided in the electronic device 10 (see FIG. 1).

The fixed plate 620 may be provided on the bottom plate 610 to be integrally connected to upper ends of the side plates 630.

The side plates 630 may be provided on the bottom plate 610 and opposite surfaces of the fixed plate 620 to integrally connect and support the bottom plate 610 and the fixed plate 620 at the same time.

The front plate 640 may be provided on the front sides of the bottom plate 610, the fixed plate 620, and the side plates 630 to be integrally connected to one end of the fixed plate 620 and to be curved so as to couple one end of the bottom plate 610 and ends of the side plates 630.

Figure 23:
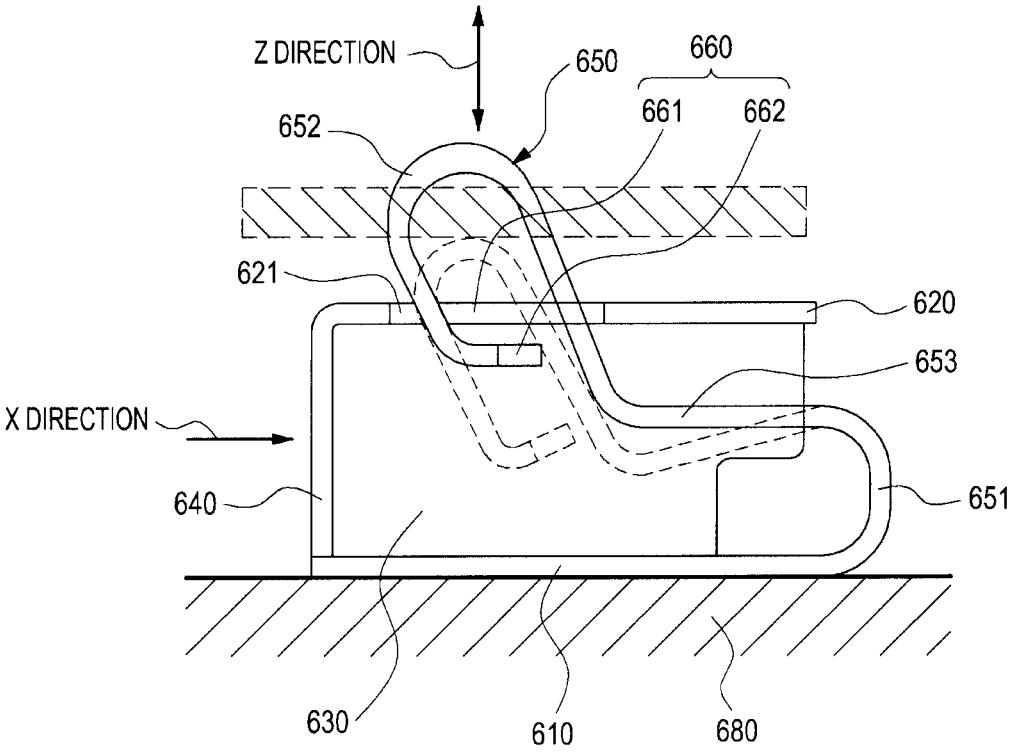
FIG. 23 is a side sectional view illustrating an operational state of a connecting terminal device according to another embodiment of the present disclosure.

The movable part 650 is connected to the rear surface of the bottom plate 610 in a curved way to be pressed by a resilient force or raised so as to be electrically connected to an external object 690 (see FIG. 23). For example, the movable part 650 may be connected to be curved towards the upper side of the rear surface of the bottom plate 610 and pass through a protruding through-hole 621 formed in the fixed plate 620 to protrude to the outside.

The rising preventing parts 660 may be provided in the fixed plate 620 and the movable part 650 to restrict rising movement of the movable part 650, thereby preventing separation of the movable part 650 from the fixed plate 620. For example, the rising preventing parts 660 may restrict a rising movement of the movable part 650 as the latches 662 are stopped by the stop portions 661 formed in the fixed plate 620.

In this way, the bottom plate 610, the fixed plate 620, the side plates 630, and the front plate 640 are coupled to each other by a convexo-concave structure 670 to present deformation of the connecting terminal device 600, so that the connecting terminal device 600 can be protected from an external force applied to the front surface of the connecting terminal device 600, the connecting terminal device 600 can be prevented or resisted from being deformed when an external impact (for example, the Z axis direction) (see FIG. 23) is applied from the upper side of the fixed plate 620, the movable part 650 can be protected from an external force of various directions (for example, the X axis direction) (see FIG. 23) applied to the connecting terminal device 600 by protecting side surfaces of the connecting terminal device 600, and a resilient force can be prevented or inhibited from being lowered or lost even when a pressing operation and a rising operation of the movable part 650 are repeatedly and consistently applied, by restricting an abnormal movement of the movable part 650 such that a deformation inferiority and a connection inferiority of the product can be prevented or inhibited.

Further, the convexo-concave structure 670 will be described in more detail. Further, referring back to FIGS. 19 and 20, the convexo-concave structure 670 may include, for example, a first boss 671 and 671*a*, a plurality of second bosses 672, a plurality of first and second recesses 673 and 674, a plurality of first coupling bosses 675, and a plurality of first and second coupling recesses 676 and 677.

The first boss 671 may be formed at one end of the bottom plate 610 to be coupled to the plurality of first coupling recesses 676 of the front plate 640, which will be described below, and the second bosses 671*a* (see FIG. 22) may be formed on a side surface of the bottom plate 610 to be coupled to the plurality of second recesses 674 of the side plates 630.

The plurality of second recesses 674 may be formed on side surfaces of the side plates 630 to be coupled to the second bosses 671*a* (see FIG. 22) formed on the side surfaces of the bottom plate, and the plurality of first recesses 673 may be formed at ends of the side plates 630 to be coupled to the first bosses 675 formed on the front plate 640.

The plurality of first coupling bosses 675 may be formed on opposite side surfaces of the front plate 640 to be coupled to the plurality of first recesses 673 of the side plates 630. The first coupling recesses 676 may be formed at a lower end of the front plate 640 to be coupled to the first bosses 671 formed at one end of the bottom plate, and the second coupling recesses 677 may be formed on the opposite surfaces of the front plate 640 to be coupled to the plurality of second bosses 672 formed at ends of the side plates 630.

According to an embodiment of the present disclosure, when the bottom plate 610, the fixed plate 620, the side plates 630, and the front plate 640 are coupled to each other by the convexo-concave structure 670, the plurality of first coupling recesses 676 formed at a lower end of the front plate 640 may be coupled to the first bosses 671 of the bottom plate, the first coupling bosses 675 formed on the opposite side surfaces of the front plate 640 may be coupled to the second coupling recesses 677 of the side plates 630, and the second coupling recesses 677 formed on the opposite side surfaces of the front plate 540 may be coupled to the plurality of second bosses 672 formed at ends of the side plates 630.

Figure 21:
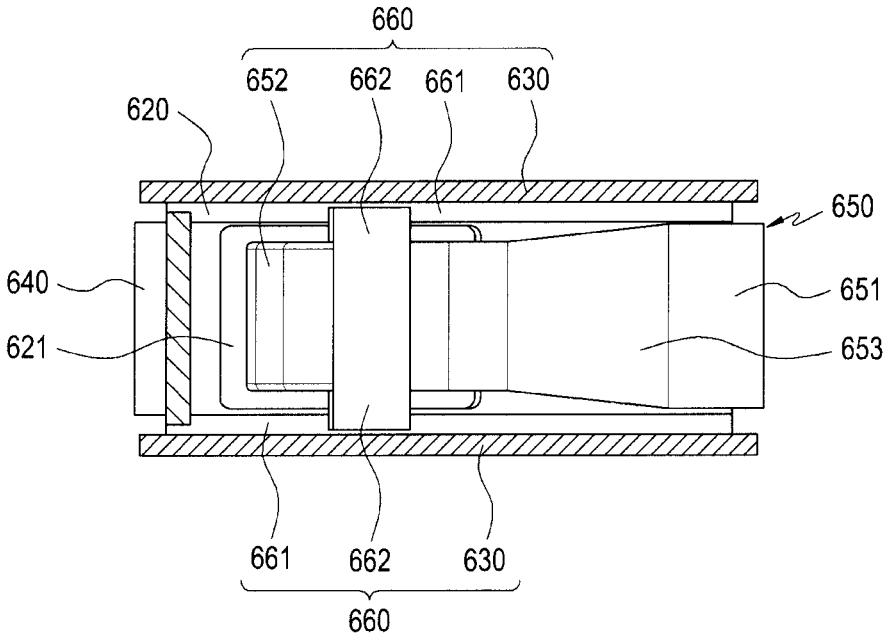
FIG. 21 is a sectional view taken along line A-A' of FIG. 19.
Figure 22:
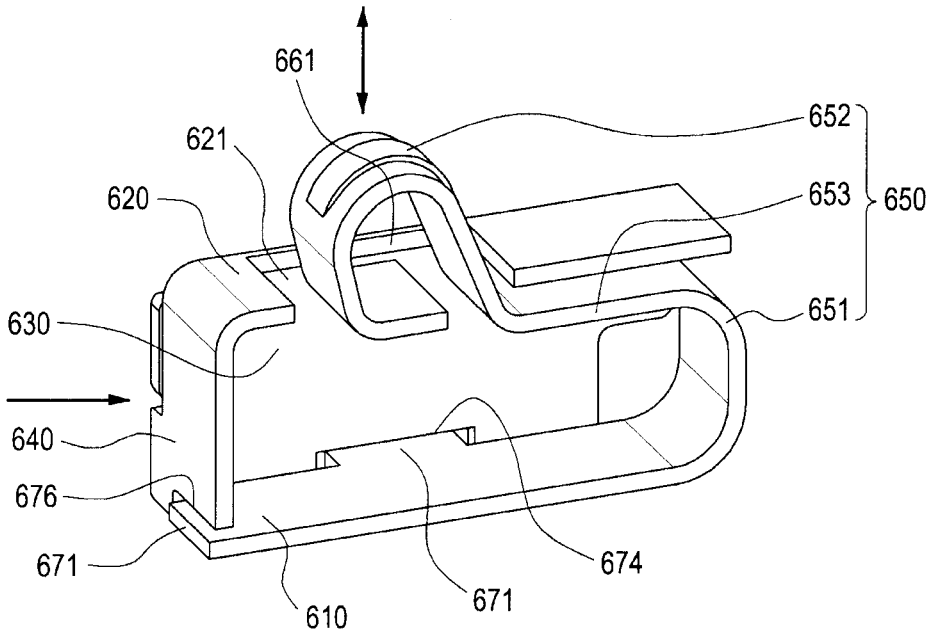
FIG. 22 is a cutaway perspective view illustrating a state before an operation of a connecting terminal device according to another embodiment of the present disclosure.

Further, the configuration of the fixed plate 620 will be described in more detail. FIG. 21 is a sectional view taken along line A-A' of FIG. 19, and is a view illustrating a state in which the latches 662 of the rising preventing parts 660 are stopped by the stop portions 661. FIG. 22 is a cutaway perspective view illustrating a state before an operation of a connecting terminal device 600 according to another embodiment of the present disclosure. FIG. 23 is a side sectional view illustrating an operational state of a connecting terminal device 600 according to another embodiment of the present disclosure.

Referring to FIGS. 21 and 22, the front surface of the fixed plate 620 may be curved to be integrally connected to the front plate 640, the movable part 650 is arranged below the fixed plate 620, and a protruding through-hole 621 may be formed in the fixed plate 620 such that the movable part 650 passes through the protruding through-hole 621 to protrude from the fixed plate 620.

For example, an upper end of the front plate 640 may be integrally formed with the front surface of the fixed plate 620 and is curved vertically at the same time, and the first coupling recess 676 formed at a lower end of the front plate 640 may be coupled to the first boss 671 formed in the bottom plate 610.

The protruding through-hole 621 may pass through the movable part 650 and protrude to the upper side of the fixed plate 620. For example, the movable part 650 protruding through the protruding through-hole 621 may be electrically connected to the external object 690.

As illustrated in FIGS. 22 and 23, the movable part 650 may include a resilient part 651, a connecting part 652, and a support 653.

The resilient part 651 may provide a resilient force to press or raise the movable part 650. The resilient part 651 may be arranged below the fixed plate 620, and may be connected to the rear surface of the bottom plate 610 to be roundly curved and may be connected to the support 653, which will be described below, at the same time. The support 653 may be provided between the resilient part 651 and the connecting part 652 to integrally connect the resilient part 651, and the connecting part 652 and extend the resilient part 651 and the connecting part 652.

The connecting part 652 may extend to the resilient part 651 to be electrically connected to the external object 690. For example, the connecting part 652 may pass through the protruding through-hole 621 to protrude to the outside and may be electrically connected to the external object 690 by the support 653 and the resilient part 651.

According to an embodiment of the present disclosure, the resilient part 651 may be arranged below the fixed plate 620, and the connecting part 652 may pass through the protruding through-hole 621 by the support 651 connected to the resilient part 653.

As illustrated in FIGS. 21 and 22, the rising preventing part 660 may include a stop portion 661 and a latch 662. For example, the stop portion 661 may pass through the latch 662 to be coupled to the latch 662, which will be described below, and may be formed in the fixed plate 620 to stop or release the latch 662.

The latch 662 extends to the outer widthwise side of the connecting part 652, and may be formed at one end of the connecting part 652 to be stopped by, or released from, the stop portion 661 when the connecting part 652 is pressed or raised.

According to an embodiment of the present disclosure, the stop portion 661 may be formed on a side surface of the protruding through-hole 621 of the fixed plate 620. For example, the latch 662 can be prevented or inhibited from being stopped by a lower portion of the stop portion 661 such that the connecting part 652 of the movable part 650 is separated from the protruding through-hole 621. Then, if the connecting part 652 is pressed, the latch 662 may be separated from the stop portion 661 while the connecting part 652 is moved downwards.

In this state, an operational process of the connecting terminal device 600 provided in the electronic device 10 (see FIG. 1) will be described in more detail as follows.

Referring back to FIG. 23, the connecting terminal device 600 according to the present disclosure mounts the bottom plate 610 on the substrate 680. Then, the substrate 680 and the bottom plate 610 may be fixed through soldering.

In this state, as illustrated in FIG. 23, the external object 690 makes contact with the connecting part 652 of the connecting terminal device 600. For example, the connecting part 652 initially makes contact with the external object 690 such as an NFC antenna installed in the rear cover of a smartphone. At a time point (connection time point) when the connecting terminal device 600 is connected, the movable part 650 of the connecting terminal device 600 mounted on the substrate 680 is moved by a predetermined height while connecting the connecting part 652 and the external object 660. Then, the resilient part 651 is resiliently deformed while absorbing an external force transferred to the connecting part 652. The movable part 650 is moved to the lower side of the fixed plate 620, the connecting part 652 is also moved to the lower side of the fixed plate 620 together with the movable part 650, and the latch 662 of the connecting part 652 is also moved to the lower side of the fixed plate 620. The latch 662 is separated from the stop portion 661 of the fixed plate 620.

Accordingly, by allowing the resilient part 651 to support the movable part 650 when the movable part 650 is pressed due to the connection of the external object 690 and the connecting part 652, the resilient force of the resilient part 651 can be prevented or inhibited from being lowered as an influence of the pressing operation on the resilient part 651 is reduced even though a force is applied to the movable part 650 consistently and repeatedly.

Further, in the connection state of FIG. 23, even when an abnormal external force (for example, an abnormal external force such as an impact occurring when a smartphone drops on the ground surface) is applied to the movable part 650, since the bottom plate 610, the fixed plate 620, the side plates 630, and the front plates 640 are coupled to each other by a convexo-concave structure 670, deformation of the connecting terminal device 600 and an impact transferred to the movable part 650 can be reduced at the same time. Accordingly, an excessive deformation of the resilient part 651 can be further prevented or inhibited.

Meanwhile, as illustrated in FIG. 23, because an external force is applied from the lower side to the upper side of the connecting part 652 by the resilient part 651, and the rising preventing parts 660 that restrict rising movement of the movable part 650 are provided on the side surfaces of the side plates 630 when the external object 690 is separated from the connecting part 652, the rising preventing part 660 may include a stop portion 661 and a latch 662. In this state, the movable part 650 is raised by a predetermined height and the latch 662 provided at an end of the connecting part 652 makes contact with the stop portion 661 formed in the fixed plate 620 to be stopped and fixed. Then, the movable part 650 can be prevented or inhibited from excessively rising as a further rising movement of the movable part 650 is blocked or resisted.

In this way, the bottom plate 610, the fixed plate 620, the side plates 630, and the front plate 640 are coupled to each other by the convexo-concave structure 670 to prevent a deformation of the connecting terminal device 600, so that the product can be protected and a deformation of the product by an external force on the front side (for example, the X axis direction) can be prevented or resisted, and an excessive movement of the movable part 650 can be prevented or resisted by the fixed plate 620 to prevent deformation of the product. Accordingly, a deformation inferiority of the product is prevented or resisted.

According to various embodiments of the present disclosure, as illustrated in FIG. 19, the connecting terminal device 600 may include a bottom plate 610; a fixed plate 620 provided on the bottom plate 610; side plates 630 provided on the bottom plate 610 and opposite side surface of the fixed plate 620; a front plate 640 provided on the front surface of the bottom plate 610, the fixed plate 620, and the side plates 630 to be coupled thereto; a movable part 650 connected to the rear surface of the fixed plate 620 in a curved fashion and protruding to the outside within the fixed plate 620 to be pressed or raised by a resilient force so as to be electrically connected to an external object 690; and rising preventing parts 660 provided in the side plates 630 to restrict a rising movement of the movable part 650 so as to prevent the movable part from being separated from the fixed plate 620, and the bottom plate 610, the fixed plate 620, the side plates 630, and the front plate 640 are coupled to each other by a convexo-concave structure 670 that is configured to prevent a deformation of the connecting terminal device 600.

According to various embodiments of the present disclosure, the convexo-concave structure may include: a plurality of first and second bosses formed at one end or on side surfaces of the bottom plate; a plurality of second bosses and a plurality of first recesses formed at ends of the side plates; a plurality of second recesses formed on the side surfaces of the side plates and coupled to the second bosses formed on the side surfaces of the bottom plate; and a plurality of first coupling bosses and a plurality of first and second coupling recesses formed in the front plate to be coupled to the first bosses of the bottom plate and coupled to the plurality of second bosses and the plurality of first recesses.

According to various embodiments of the present disclosure, the front surface of the fixed plate may be integrally connected to the front plate in a curved fashion, and a protruding through-hole through which the movable part passes to protrude from the fixing plate by a predetermined height may be formed on the upper surface of the fixed plate.

According to various embodiments of the present disclosure, the movable part may include: a resilient part arranged below the fixed plate and connected to the rear surface of the bottom plate in a curved fashion to provide a resilient force as the movable part is pressed or raised; a connecting part extending from the resilient part to be electrically connected to the external object; and a support provided between the resilient part and the connecting part and extending such that the resilient part and the connecting part are integrally connected to each other.

According to various embodiments of the present disclosure, the rising preventing parts may include: stop portions formed in the fixed plate; and latches formed at ends of the connecting part and extending to the outer widthwise side of the connecting party, the latches being configured to be stopped by, or released from, the stop portions when the connecting part is pressed or raised.

According to various embodiments of the present disclosure, the stop portions may be formed on side surfaces of the protruding through-hole of the fixed plate.

According to various embodiments of the present disclosure, a connecting terminal device provided in an electronic device may include: a substrate provided in the electronic device; a bottom plate fixed to the substrate; a fixed plate provided on the bottom plate; side plates provided on the bottom plate and opposite side surface of the fixed plate; a front plate provided on the front surface of the bottom plate, the fixed plate, and the side surfaces to be coupled thereto; a movable part connected to the rear surface of the bottom plate in a curved fashion and protruding to the outside within the fixed plate to be pressed or raised by a resilient force so as to be electrically connected to an external object; and rising preventing parts provided in the fixed plate and the movable part to restrict a rising movement of the movable part so as to prevent the movable part from being separated from the fixed plate, the bottom plate, the fixed plate, the side plates, and the front plate may be coupled to each other by a convexo-concave structure, which is configured to prevent deformation of the connecting terminal device.

It will be apparent to those skilled in the art that the connection terminal device and electronic apparatus having the same according to various embodiments of the present disclosure is not limited to the above described embodiments and drawings, and various modifications, changes, and substitutions may be made thereto without departing from the spirit and scope of the present disclosure as defined by the appended claims.

What is claimed is:

1. A connecting terminal device comprising:

a bottom plate;

a movable part provided on a rear surface of the bottom plate and configured to be electrically connected to an external object as the movable part is pressed or raised;

at least one protective wall provided on at least one side surface of the bottom plate;

a pressing preventing part provided at least at one end of the at least one protective wall and provided between the bottom plate and the movable part to make contact with the movable part as the movable part is pressed, thereby restricting pressing movement of the movable part; and a rising preventing part provided on at least one side surface of the protective walls to restrict a rising movement of the movable part.

2. A connecting terminal device comprising:

a bottom plate;

a movable part connected to a rear surface of the bottom plate in a curved fashion and configured to be pressed or raised by a resilient force to be electrically connected to an external object;

one or more protective walls provided on side surfaces of the bottom plate, the one or more protective walls being configured to protect the movable part;

one or more pressing preventing parts provided at ends of the protective walls and provided between the bottom plate and the movable part to make contact with the movable part as the movable part is pressed, thereby restricting pressing movement of the movable part;

one or more rising preventing parts provided on side surfaces of the protective walls to prevent rising movement of the movable part so as to prevent the movable part from being separated from the protective walls; and a stopper provided on the bottom plate to restrict movement of the movable part in a pressing direction.

3. The connecting terminal device of claim 2, wherein the movable part comprises:

a resilient part connected to the rear surface of the bottom plate to be roundly curved upwards to provide a resilient force as the movable part is pressed or raised;

a connecting part extending from the resilient part upwards by a predetermined height to be electrically connected to the external object; and an absorbing surface provided between the resilient part and the connecting part and extending such that the resilient part and the connecting part are integrally connected to each other.

4. The connecting terminal device of claim 3, wherein the resilient part is roundly bent upwards in an elliptical or a semi-elliptical shape, and the pressing preventing parts are situated inside the resilient part.

5. The connecting terminal device of claim 2, wherein the protective walls comprise:

side walls formed on opposite surfaces of the bottom plate to be vertically and horizontally bent, the side walls being configured to protect side surfaces of the movable part; and a front wall formed on a front surface of the bottom plate to be vertically bent to protect a front surface of the movable part.

6. The connecting terminal device of claim 5, wherein the pressing preventing parts comprise side supports formed on side surfaces of ends of the side walls to be vertically bent to make contact with the movable part as the movable part is pressed.

7. The connecting terminal device of claim 5, wherein the rising preventing parts comprise:

cutaway portions formed on the side walls;

stop portions formed in the cutaway portions; and latches formed at ends of a connecting part and extending to an outer widthwise side of the connecting part to be stopped by or released from the stop portions.

8. The connecting terminal device of claim 7, wherein the cutaway portions are cut away to be continuously connected to the side walls and the entire bottom plate except for upper end portions of the side walls at portions of the side walls where the connecting part is situated.

9. The connecting terminal device of claim 7, further comprising a stopper recess formed on a front surface of the connecting part, wherein the stopper is receivable within the stopper recess and is configured to be inserted into or separated from the stopper recess when the connecting part is moved.

10. The connecting terminal device of claim 2, wherein the stopper has an inverse U-shape.

11. The connecting terminal device of claim 7, wherein the protective walls are tunnel type protective walls divided forwards and rearwards through the cutaway portions, and the protective walls are fixedly soldered to a substrate as lower end portions of the side walls situated on a front side of the cutaway portions extend to the bottom plate.

12. A connecting terminal device comprising:

a bottom plate;

one or more protective walls provided on side surfaces of the bottom plate, the one or more protective walls being configured to protect a movable part configured to be electrically connected to an external object;

pressing preventing parts provided at ends of the protective walls and provided between the bottom plate and the movable part to make contact with the movable part as the movable part is pressed so as to be connected to a rear surface of the bottom plate in a curved fashion so that the pressing preventing parts are pressed or raised by a resilient force such that pressing movement of the movable part is restricted; and rising preventing parts provided on side surfaces of the protective walls to restrict rising movement of the movable part so as to prevent the movable part from being separated from the protective walls.

13. The connecting terminal device of claim 12, wherein the protective walls comprise:

side walls formed on opposite surfaces of the bottom plate, the side walls being vertically and horizontally bent to protect side surfaces of the movable part; and a front wall formed on a front surface of the bottom plate, the front wall being vertically bent to protect a front surface of the movable part.

14. The connecting terminal device of claim 13, wherein the pressing preventing parts comprise side supports formed on side surfaces of ends of the side walls, the pressing preventing parts being vertically bent to make contact with the movable part as the movable part is pressed.

15. The connecting terminal device of claim 13, wherein the rising preventing parts comprise:

cutaway portions formed in the bottom plate and the side walls;

stop portions formed at upper ends of the cutaway portions; and latches formed at ends of a connecting part and extending to an outer widthwise side of the connecting part, the latches being configured to be stopped by, or released from, the stop portions.

16. The connecting terminal device of claim 15, wherein the cutaway portions comprise divided recesses that divide the bottom plate and the side walls in a forwards and rearwards direction.

17. The connecting terminal device of claim 15, wherein the pressing preventing parts comprise upper supports formed at upper ends of the side walls to be horizontally bent so as to make contact with a lower surface of the movable part as the movable part is pressed.

18. The connecting terminal device of claim 15, wherein the rising preventing parts comprise:

cutaway portions formed on the side walls to pass through the side walls;

first stop portions formed at upper ends of the cutaway portions;

second stop portions formed at lower ends of the cutaway portions; and latches formed at ends of the connecting part and extending to the outer widthwise side of the connecting part, the latches being configured to be stopped by or released from the first and second stop portions when the connecting part is pressed or raised.

19. The connecting terminal device of claim 18, wherein the cutaway portions are connected to through-holes through which the latches pass to be coupled thereto.

20. A connecting terminal device comprising:

a bottom plate;

a movable part connected to a rear surface of the bottom plate in a curved fashion and pressed or raised by a resilient force, the movable part configured to be electrically connected to an external object;

one or more protective walls provided on side surfaces of the bottom plate to protect the movable part;

one or more first pressing preventing parts provided at ends of the protective walls and provided between the bottom plate and the movable part to make contact with the movable part as the movable part is pressed, restricting pressing movement of the movable part;

a second pressing preventing part provided at one end of the movable part such that one end of the movable part makes contact with the bottom plate as the movable part is pressed, thereby restricting pressing movement of the movable part; and rising preventing parts provided on side surfaces of the protective walls to prevent rising movement of the movable part so as to prevent the movable part from being separated from the protective walls.

21. The connecting terminal device of claim 20, wherein the movable part comprises:

a resilient part connected to the rear surface of the bottom plate to be roundly curved upwards to provide a resilient force as the movable part is pressed or raised;

a connecting part extending from the resilient part upwards by a predetermined height, the connecting part configured to be electrically connected to the external object; and an absorbing surface provided between the resilient part and the connecting part and extending such that the resilient part and the connecting part are integrally connected to each other.

22. The connecting terminal device of claim 21, wherein the protective walls comprise:

side walls formed on opposite surfaces of the bottom plate, the side walls being vertically and horizontally bent to protect side surfaces of the movable part; and a front wall formed on a front surface of the bottom plate, the front wall being vertically bent to protect a front surface of the movable part.

23. The connecting terminal device of claim 22, further comprising an insertion hole formed in the front wall, the connection part being inserted and separated from the insertion hole as the movable part is pressed and raised.

24. The connecting terminal device of claim 22, wherein the first pressing preventing parts comprise side supports formed on side surfaces of ends of the side walls, the first pressing parts configured to be vertically bent to make contact with the movable part as the movable part is pressed.

25. The connecting terminal device of claim 22, wherein the second pressing part comprises a curved support such that a contact part is slid when making contact with the bottom plate as the movable part is pressed.

26. A connecting terminal device provided in an electronic device, comprising:

a substrate provided in the electronic device;

a bottom plate fixed to the substrate;

a movable part connected to a rear surface of the bottom plate in a curved fashion and pressed or raised by a resilient force, the movable part being configured to be electrically connected to an external object;

one or more protective walls provided on side surfaces of the bottom plate to protect the movable part;

pressing preventing parts provided at ends of the protective walls and provided between the bottom plate and the movable part to make contact with the movable part as the movable part is pressed, thereby restricting a pressing movement of the movable part;

rising preventing parts provided on side surfaces of the protective walls to restrict rising movement of the movable part, the rising preventing parts configured to prevent the movable part from being separated from the protective walls; and a stopper provided on the bottom plate to restrict a movement of the movable part in a pressing direction.

27. A connecting terminal device provided in an electronic device, comprising:

a substrate provided in the electronic device;

a bottom plate fixed to the substrate;

a movable part connected to a rear surface of the bottom plate in a curved fashion and configured to be pressed or raised by a resilient force to be electrically connected to an external object;

one or more protective walls provided on side surfaces of the bottom plate to protect the movable part;

pressing preventing parts provided at ends of the protective walls and provided between the bottom plate and the movable part to make contact with the movable part as the movable part is pressed, thereby restricting a pressing movement of the movable part; and rising preventing parts provided on side surfaces of the protective walls to restrict a rising movement of the movable part so as to prevent the movable part from being separated from the protective walls.

28. A connecting terminal device provided in an electronic device, comprising:

a substrate provided in the electronic device;

a bottom plate fixed to the substrate;

a movable part connected to a rear surface of the bottom plate in a curved fashion and configured to be pressed or raised by a resilient force to be electrically connected to an external object;

one or more protective walls provided on side surfaces of the bottom plate, the one or more protective walls being configured to protect the movable part;

first pressing preventing parts provided at ends of the protective walls and provided between the bottom plate and the movable part to make contact with the movable part as the movable part is pressed, thereby restricting a pressing movement of the movable part;

a second pressing preventing part provided at one end of the movable part such that one end of the movable part makes contact with the bottom plate as the movable part is pressed, thereby restricting rising movement of the movable part; and rising preventing parts provided on side surfaces of the protective walls to restrict a rising movement of the movable part so as to prevent the movable part from being separated from the protective walls.

29. A connecting terminal device comprising:

a bottom plate;

a fixed plate provided on the bottom plate;

side plates provided on the bottom plate and opposite side surface of the fixed plate;

a front plate provided on a front surface of the bottom plate, the fixed plate and the side plates being coupled to the front plate;

a movable part connected to a rear surface of the fixed plate in a curved fashion and protruding to the outside within the fixed plate to be pressed or raised by a resilient force, the movable part being configured to be electrically connected to an external object; and rising preventing parts provided in the side plates to restrict rising movement of the movable part, the rising preventing parts being configured to prevent the movable part from being separated from the fixed plate, wherein the bottom plate, the fixed plate, the side plates, and the front plate are coupled to each other by a convexo-concave structure to a prevent deformation of the connecting terminal device.

30. The connecting terminal device of claim 29, wherein the convexo-concave structure comprises:

a bottom boss formed at one end of the bottom plate;

side bosses and side recesses formed at ends of the side plates; and a plurality of first coupling bosses and a plurality of first and second coupling recesses formed on the front surface to be coupled to the bottom boss and coupled to the side bosses and the side recesses.

31. The connecting terminal device of claim 29, wherein a plurality of soldering holes, into which lead is inserted during soldering, are formed in the bottom plate.

32. The connecting terminal device of claim 29, wherein a front surface of the fixed plate is integrally connected to the front plate in a curved fashion, the rear surface of the fixed plate is connected to the movable part in a curved fashion, and a protruding through-hole, through which the movable part passes to protrude from the fixing plate by a predetermined height, is formed on an upper surface of the fixed plate.

33. The connecting terminal device of claim 29, wherein the movable part comprises:

a resilient part connected to the rear surface of the fixed plate to be roundly curved downwards to provide a resilient force as the movable part is pressed or raised;

a connecting part extending from the resilient part, the connecting part configured to be electrically connected to an external object; and a support provided between the resilient part and the connecting part and extending such that the resilient part and the connecting part are integrally connected to each other.

34. The connecting terminal device of claim 29, wherein the rising preventing parts comprise:

cutaway portions formed in the side plates, the cutaway portions being configured to pass through the side plates;

first stop portions formed at upper ends of the cutaway portions;

second stop portions formed at lower ends of the cutaway portions; and latches formed at ends of a connecting part and extending to an outer widthwise side of the connecting part, the latches being configured to be stopped by or released from the first and second stop portions when the connecting part is pressed or raised.

35. The connecting terminal device of claim 34, wherein the cutaway portions are connected to catching through-holes through which the latches pass to be coupled thereto.

36. A connecting terminal device provided in an electronic device comprising:

a substrate provided in the electronic device;

a bottom plate fixed to the substrate;

a fixed plate provided on the bottom plate;

side plates provided on the bottom plate and an opposite side surface of the fixed plate;

a front plate provided on a front surface of the bottom plate, the fixed plate and the side surfaces being coupled to the front plate;

a movable part connected to a rear surface of the fixed plate in a curved fashion and protruding to the outside through the fixed plate, the movable part being configured to be pressed or raised by a resilient force and being configured to be electrically connected to an external object; and rising preventing parts provided in the side plates to restrict rising movement of the movable part so as to prevent the movable part from being separated from the fixed plate, wherein the bottom plate, the fixed plate, the side plates, and the front plate are coupled to each other by a convexo-concave structure to prevent a deformation of the connecting terminal device.

37. A connecting terminal device comprising:

a bottom plate;

a fixed plate provided on the bottom plate;

side plates provided on the bottom plate and opposite side surfaces of the fixed plate;

a front plate provided on a front surface of the bottom plate, the fixed plate and the side surfaces being coupled to the front plate;

a movable part connected to a rear surface of the bottom plate in a curved fashion and protruding to the outside within the fixed plate and configured to be pressed or raised by a resilient force and to be electrically connected to an external object; and rising preventing parts provided in the fixed plate and the movable part, the rising preventing parts configured to restrict rising movement of the movable part so as to prevent the movable part from being separated from the fixed plate, wherein the bottom plate, the fixed plate, the side plates, and the front plate are coupled to each other by a convexo-concave structure, the convexo-concave structure being configured to prevent a deformation of the connecting terminal device.

38. The connecting terminal device of claim 37, wherein the convexo-concave structure comprises:

a plurality of first and second bosses formed at an end or on side surfaces of the bottom plate;

a plurality of second bosses and a plurality of first recesses formed at ends of the side plates;

a plurality of second recesses formed on the side surfaces of the side plates and coupled to the second bosses formed on the side surfaces of the bottom plate; and a plurality of first coupling bosses and a plurality of first and second coupling recesses formed in the front plate to be coupled to the first bosses of the bottom plate and coupled to the plurality of second bosses and the plurality of first recesses.

39. The connecting terminal device of claim 38, wherein a front surface of the fixed plate is integrally connected to the front plate in a curved fashion, and a protruding through-hole through which the movable part passes to protrude from the fixing plate by a predetermined height, the through-hole being formed on an upper surface of the fixed plate.

40. The connecting terminal device of claim 37, wherein the movable part comprises:

a resilient part arranged below the fixed plate and connected to the rear surface of the bottom plate in a curved fashion to provide a resilient force as the movable part is pressed or raised;

a connecting part extending from the resilient part to be electrically connected to the external object; and a support provided between the resilient part and the connecting part and extending such that the resilient part and the connecting part are integrally connected to each other.

41. The connecting terminal device of claim 37, wherein the rising preventing parts comprise:

stop portions formed in the fixed plate; and latches formed at ends of a connecting part and extending to an outer widthwise side of the connecting part to be stopped by or released from the stop portions when the connecting part is pressed or raised.

42. The connecting terminal device of claim 41, wherein the stop portions are formed on side surfaces of the protruding through-hole of the fixed plate.

43. A connecting terminal device provided in an electronic device comprising:

a substrate provided in the electronic device;

a bottom plate fixed to the substrate;

a fixed plate provided on the bottom plate;

side plates provided on the bottom plate and opposite side surface of the fixed plate;

a front plate provided on a front surface of the bottom plate, the fixed plate and the side surfaces being coupled to the front plate;

a movable part connected to a rear surface of the bottom plate in a curved fashion and protruding to the outside within the fixed plate to be pressed or raised by a resilient force, the movable part being configured to be electrically connected to an external object; and rising preventing parts provided in the fixed plate and the movable part to restrict a rising movement of the movable part, the rising preventing parts being configured to prevent the movable part from being separated from the fixed plate, wherein the bottom plate, the fixed plate, the side plates, and the front plate are coupled to each other by a convexo-concave structure, the convexo-concave structure being configured to prevent a deformation of the connecting terminal device.

* * * * *